US008449356B1

(12) United States Patent
Sae-Lee

(10) Patent No.: US 8,449,356 B1
(45) Date of Patent: May 28, 2013

(54) HIGH PRESSURE COOLING NOZZLE FOR SEMICONDUCTOR PACKAGE

(75) Inventor: Charun Sae-Lee, Samutprakan (TH)

(73) Assignee: Utac Thai Limited, Bangna, Bangkok (TH)

( * ) Notice: Subject to any disclaimer, the term of this patent is extended or adjusted under 35 U.S.C. 154(b) by 1076 days.

(21) Appl. No.: 12/220,236

(22) Filed: Jul. 22, 2008

Related U.S. Application Data

(60) Provisional application No. 61/003,231, filed on Nov. 14, 2007.

(51) Int. Cl.
*B24B 55/02* (2006.01)

(52) U.S. Cl.
USPC ..... 451/450; 29/890.09; 451/449; 451/488

(58) Field of Classification Search
USPC ..... 15/230.1; 29/890.09; 83/22, 169; 451/41, 451/53, 449, 450, 488, 60
See application file for complete search history.

(56) References Cited

U.S. PATENT DOCUMENTS

| | | | | |
|---|---|---|---|---|
| 3,169,923 | A | 2/1965 | Guarnaccio et al. | 252/32.5 |
| 3,203,895 | A | 8/1965 | Latos et al. | 252/32.5 |
| 3,750,847 | A | 8/1973 | Sluhan | |
| 3,877,682 | A | 4/1975 | Moss | |
| 4,419,234 | A | 12/1983 | Miller et al. | |
| 4,484,417 | A * | 11/1984 | Klingerman | 451/53 |
| 4,772,402 | A | 9/1988 | Love | |
| 4,782,591 | A * | 11/1988 | DeVito et al. | 30/123.3 |
| 5,048,599 | A | 9/1991 | Tustaniwskyj et al. | |
| 5,244,586 | A | 9/1993 | Hawkins et al. | |
| 5,372,220 | A | 12/1994 | Jacobs et al. | 184/6.14 |
| 5,494,134 | A | 2/1996 | McConkey | |
| 5,578,529 | A * | 11/1996 | Mullins | 438/692 |
| 5,832,585 | A | 11/1998 | Takiar et al. | 29/424 |
| 5,923,995 | A | 7/1999 | Kao et al. | 438/460 |
| 6,006,736 | A * | 12/1999 | Suzuki et al. | 125/13.02 |
| 6,139,406 | A * | 10/2000 | Kennedy et al. | 451/67 |
| 6,386,948 | B1 | 5/2002 | Kondo | |
| 6,414,385 | B1 | 7/2002 | Huang et al. | 257/690 |
| 6,416,587 | B1 * | 7/2002 | Lu et al. | 134/2 |
| 6,428,883 | B1 | 8/2002 | White | 428/323 |
| 6,451,709 | B1 | 9/2002 | Hembree | 438/759 |
| 6,508,944 | B1 | 1/2003 | Bratten | |
| 6,521,513 | B1 | 2/2003 | Lebens et al. | 438/462 |
| 6,655,245 | B2 | 12/2003 | Schuettel | |

(Continued)

OTHER PUBLICATIONS

Office Action dated Oct. 3, 2012, U.S. Appl. No. 12/070,191, filed Feb. 14, 2008, Sorasak Utahin et al.

(Continued)

*Primary Examiner* — Timothy V Eley
(74) *Attorney, Agent, or Firm* — Haverstock & Owens LLP

(57) ABSTRACT

A fluid discharge method and apparatus is provided. The fluid discharge apparatus includes a first structure defining a first duct therein, a second structure defining a second duct therein and a third structure defining a third duct therein. Conduits formed in the structures, accurately positioned during machining thereof, extend from openings towards the ducts. Fluid in the ducts is initially directed into the conduits and subsequently out of the openings towards a cutting area comprising portions of a cutting blade and a workpiece being processed by the cutting blade. The conduits are shaped for generating a nozzle-type flow therethrough for accurate directional control of fluid streams discharged from the conduits. A method of forming the fluid discharge apparatus is also provided.

80 Claims, 13 Drawing Sheets

U.S. PATENT DOCUMENTS

| | | | | |
|---|---|---|---|---|
| 6,669,538 | B2 * | 12/2003 | Li et al. | 451/56 |
| 6,743,076 | B2 * | 6/2004 | Adachi et al. | 451/6 |
| 6,902,469 | B2 | 6/2005 | Kondo et al. | |
| 6,938,633 | B2 | 9/2005 | Sugata et al. | |
| 7,014,552 | B1 * | 3/2006 | Collier et al. | 452/56 |
| 7,021,999 | B2 * | 4/2006 | Jiang et al. | 451/60 |
| 7,281,535 | B2 | 10/2007 | Mihai et al. | 125/13.01 |
| 2005/0056135 | A1 | 3/2005 | Hall et al. | 83/851 |
| 2005/0268899 | A1 | 12/2005 | Mihia et al. | 125/13.01 |
| 2007/0175304 | A1 | 8/2007 | In't Veld et al. | 83/169 |
| 2009/0223942 | A1 | 9/2009 | Heyl | |

OTHER PUBLICATIONS

Office Action dated Oct. 3, 2012, U.S. Appl. No. 13/235,124, filed Sep. 16, 2011, Sorasak Utathin et al.

* cited by examiner

HIGH PRESSURE COOLING NOZZLE FOR SEMICONDUCTOR PACKAGE

RELATED APPLICATIONS

This application claims benefit of priority under 35 U.S.C. section 119(e) of the co-pending U.S. Provisional Patent Application Ser. No. 61/003,231 filed Nov. 14, 2007, entitled "HIGH PRESSURE COOLING NOZZLE FOR SEMICONDUCTOR PACKAGE," which is hereby incorporated by reference in its entirety.

FIELD OF THE INVENTION

The present invention is related to the field of semiconductor device manufacturing. More specifically, the present invention relates to high speed singulation cooling systems for semiconductor devices.

BACKGROUND

The manufacture of semiconductor integrated circuits has become a competitive, high volume commodity business. As such, controlling the cost of each completed circuit improves the commercial effectiveness of that circuit. For the semiconductor manufacturing industry, the time necessary to complete each manufacturing step has a direct relationship and effect on the cost of that circuit. One time-consuming phase during the fabrication of semiconductor devices is singulation. Singulation is a process for dicing a sheet of fabricated semiconductor die and/or packages into individual units. Semiconductor dice are typically mass produced on a wafer and good dice are mounted on a leadframe. The leadframes are also typically mass produced in large batches by the sheet. Depending on the manufacturing process, the sheet of leadframes can have an adhesive (dicing) tape applied to one side of the sheet before an encapsulation is applied to the dice mounted on the leadframes. The encapsulation is typically performed by molding a plastic resin to the sheet of dice and leadframes. In these cases, the dicing tape provides a lower support structure for the formation of the plastic molding during encapsulation. The encapsulation is commonly referred to as a semiconductor package.

A singulation process separates each package from the molded sheet. The molded sheet is typically divided into molded strips for singulation. There are various techniques currently being practiced for singulation. One technique involves punching, while another technique involves sawing the molded strip to separate the packages from the molded strip. Two particular drawbacks related to sawing the molded strip are (1) lengthy singulation times and (2) defects in the singulated product. Both drawbacks are related to the heat generated by the singulation blade. The saw blade cuts the resin and can cut the lead frame into a plurality of particles. While cutting, the blade forms a well-known trench-like kerf. The kerf can fill with particles which can bind between the blade and a wall of the kerf. The particles can damage the wall of the kerf leading to failures or reliability problems.

The conventional method for singulating semiconductor packages uses a dicing saw having a saw blade which is typically very thin (approximately 0.2 mm-0.3 mm) and which rotates at a very high speed. Jets of fluid directed at the saw blade to cool it as it cuts the substrate have the unintended effect of easily deflecting the thin cutting blade when the jets of fluid impacting outwardly opposing sides of the cutting blade are misaligned. This is caused by the imbalance in forces created by the misaligned fluid jets impacting the saw blade on either of its side. The higher the cutting rate is desired, the higher the rate of discharge of fluid is needed to cool the blade. However, under the conventional method the higher the rate of discharge of fluid, the greater the effect of imbalanced impact of forces on either side of the blade results. This in turn causes the cutting blade to vibrate due to dynamic imbalance when the saw blade rotates at a very high speed which in turns lead to inefficient cutting thus constraining cutting speeds and the attainment of quality cuts.

FIG. 1 through FIG. 4A shows a conventional cooling system comprising a discharge apparatus 100 having two pipes 102 for receiving fluid through an interface 130, a center blade cooling nozzle 110, and a cutting blade 106 (FIG. 1). The apparatus uses water or a chemical coolant in order to transfer heat and also to lubricate at a cutting area. FIGS. 2 and 2A show holes 104 formed along a portion of each of the two pipes for discharging the fluid. The cutting blade 106 is typically displaced between the two pipes 102 with the holes 104 of each of the two pipes 102 facing a portion of the cutting blade 106, while a hole 112 (FIG. 4A) of the center blade cooling nozzle 110 faces towards the cutting blade 106 and the cutting area for discharging the fluid onto the cutting blade for cooling thereof. The holes 104 direct fluid in a trapezoidal shape 108 and the hole 112 directs fluid in a cone shaped spray 114 both because of substantial dispersion of fluid fail to sufficiently direct cooling fluid at the cutting area. Further, the present apparatus 100 fails to efficiently remove debris from the cutting area. Also, to direct the discharged fluid onto the cutting blade 106, the holes 104 on the two pipes 102 are manually positioned by hand-bending the two pipes 102. However, hand-bending of the two pipes 102 is an inaccurate and crude manner for aligning the holes 104. Additionally, hand-bending of the two pipes 102 may lead to fracturing of either of the two pipes 102.

Accordingly, there is a need to accelerate the singulation process without negatively affecting quality or reliability of the singulated product and improve an apparatus for directing fluid at the cutting blades.

SUMMARY OF THE DISCLOSURE

In accordance with a first aspect of the present invention, a fluid discharge apparatus is provided. The fluid discharge apparatus includes a first structure defining a first duct therein, a second structure defining a second duct therein and a third structure defining a third duct therein. The first structure further defines a first conduit extending from the first duct and terminating at a first opening. The second structure further defines a second conduit extending from the second duct and terminating at a second opening. The third structure further defines a third conduit extending from the third duct and terminating at a third opening. Each of the first conduit, the second conduit and the third conduit is shaped and dimensioned for generating a nozzle-type flow therethrough. The first structure is spatially displaced from the second structure for receiving a cutting blade therebetween. The cutting blade is for cutting a work-piece. The first duct is for receiving fluid thereinto and for directing the fluid to the first conduit for discharge through the first opening. The second duct is for receiving fluid thereinto and for directing the fluid to the second conduit for discharge through the second opening and the third duct is for receiving fluid thereinto and for directing the fluid to the third conduit for discharge through the third opening. The fluid is directed by the first conduit and the second conduit towards at least one of a portion of the work-piece and two directly outwardly opposing surface portions of the cutting blade. Further, the fluid is directed by the third conduit towards at least one of a portion of the work-piece and two directly towards portions of area. A direction of discharge of the fluid from the first conduit, second conduit and third conduit is determined by position and orientation of each of the first conduit, the second conduit and the third conduit. The position and orientation of the first conduit with reference to the position and orientation of the second conduit and the third conduit is determined during forming of the first conduit, the second conduit and the third conduit in the first structure, the second structure and the third structure.

In accordance with a second aspect of the present invention, a fluid discharge method for aligning directions of discharge of fluid streams onto a cutting area is provided. The method includes providing a first structure defining a first duct therein, providing a second structure defining a second duct therein and providing a third structure defining a third duct therein. The first structure further defines a first conduit extending from the first duct and terminating at a first opening. The second structure further defines a second conduit extending from the second duct and terminating at a second opening. The third structure further defines a third conduit extending from the third duct and terminating at a third opening. Each of the first conduit, the second conduit and the third conduit is shaped and dimensioned for generating a nozzle-type flow therethrough. The first structure is spatially displaced from the second structure. The first duct is for receiving fluid thereinto and for directing the fluid to the first conduit for discharge through the first opening as a first fluid stream. The second duct is for receiving fluid thereinto and for directing the fluid to the second conduit for discharge through the second opening as a second fluid stream and the third duct is for receiving fluid thereinto and for directing the fluid to the third conduit for discharge through the third opening as a third fluid stream.

A cutting blade is disposed between the first structure and the second structure. The cutting blade is for cutting a work-piece. The discharge direction of the first fluid stream is aligned with the discharged direction of the second fluid stream onto a cutting area. The cutting area is at least one of a portion of the work-piece and two directly outwardly opposing surface portions of the cutting blade. The discharge direction of the third fluid stream is aligned with a cutting area. The discharge direction of the first, second and third fluid streams are determined by position and orientation of each of the first conduit, the second and the third conduit. The position and orientation of the first conduit with reference to the position and orientation of the second conduit is determined during forming of the first conduit and the second conduit.

In accordance with a third aspect of the present invention, a method of forming a fluid discharge apparatus is provided. The method includes forming a first structure defining a first duct therein, forming a second structure defining a second duct therein and forming a third structure defining a third duct therein. The first structure is spatially displaced from the second structure and the third structure is spatially displaced from the first and second structure. Forming a first conduit in the first structure extending from the first duct and terminating at a first opening. Forming a second conduit in the second structure extending from the second duct and terminating at a second opening and forming a third conduit in the third structure extending from the third duct and terminating at a third opening. Each of the first structure, the second structure and the third structure is inter-disposed in a pre-determined configuration one of prior to and during forming of the first conduit, the second conduit and the third conduit. Each of the first conduit, the second conduit and the third conduit is shaped and dimensioned for generating a nozzle-type flow therethrough. The first duct is for receiving fluid thereinto and for directing the fluid to the first conduit for discharge through the first opening. The second duct is for receiving fluid thereinto and for directing the fluid to the second conduit for discharge through the second opening and the third duct is for receiving fluid thereinto and for directing the fluid to the third conduit for discharge through the third opening.

A cutting blade for cutting a work-piece is disposable between the first structure, the second structure and the third structure. The fluid discharged by the first conduit and the second conduit is directed towards at least one of a portion of the work-piece and two directly outwardly opposing surface portions of the cutting blade. The fluid discharged by the third conduit is directed towards at least one of a portion of the work-piece and two directly towards portions of a cutting area. A discharge direction of the fluid from the first conduit, second conduit and third conduit is determined by a position and orientation of each of the first conduit, the second conduit and the third conduit. The position and orientation of the first conduit with reference to the position and orientation of the second conduit is determined during forming of the first conduit and the second conduit.

In accordance with a fourth aspect of the invention, there is disclosed a fluid discharge apparatus comprising a first structure defining a first duct therein and a second structure defining a second duct therein. The first structure further defines a first conduit extending from the first duct and terminating at a first opening. The second structure further defines a second conduit extending from the second duct and terminating at a second opening. Each of the first conduit and the second conduit is shaped and dimensioned for generating a nozzle-type flow therethrough. The first structure is spatially displaced from the second structure for receiving a cutting blade therebetween. The cutting blade is for cutting a work-piece. The first duct is for receiving fluid thereinto and for directing the fluid to the first conduit for discharge through the first opening and the second duct is for receiving fluid thereinto and for directing the fluid to the second conduit for discharge through the second opening. The fluid is directed by the first conduit and the second conduit towards at least one of a portion of the work-piece and two directly outwardly opposing surface portions of the cutting blade. Direction of discharge of the fluid from the first conduit and second conduit is determined by position and orientation of each of the first conduit and the second conduit, the position and orientation of the first conduit with reference to the position and orientation of the second conduit is determined during forming of the first conduit and the second conduit in the first structure and the second structure.

In accordance with a fifth aspect of the invention, there is disclosed a fluid discharge method for aligning directions of discharge of fluid streams onto a cutting area. The method comprises providing a first structure defining a first duct therein. The first structure further defining a first conduit extending from the first duct and terminating at a first opening. Next, a second structure is provided for defining a second duct therein. The second structure further defining a second conduit extending from the second duct and terminating at a second opening. Each of the first conduit and the second conduit is shaped and dimensioned for generating a nozzle-type flow therethrough. The first structure is spatially displaced from the second structure. The first duct is for receiving fluid thereinto and for directing the fluid to the first conduit for discharge through the first opening as a first fluid stream and the second duct is for receiving fluid thereinto and for directing the fluid to the second conduit for discharge through the second opening as a second fluid stream. A cutting blade is disposed between the first structure and the second structure. The cutting blade is for cutting a work-piece. The discharge direction of the first fluid stream is aligned with the discharge direction of the second fluid directed onto a cutting area. The cutting area is at least one of a portion of the work-piece and two directly outwardly opposing surface portions of the cutting blade. Direction of discharge of each of the first and second fluid streams from the first conduit and second conduit is determined by position and orientation of each of the first conduit and the second conduit. The position and orientation of the first conduit with reference to the position and orientation of the second conduit is determined during forming of the first conduit and the second conduit in the first structure and the second structure.

In accordance with a sixth aspect of the invention, there is disclosed a fluid discharge apparatus forming method comprising forming a first structure defining a first duct therein and forming a second structure defining a second duct therein. The first structure is spatially displaced from the second structure. Forming a first conduit in the first structure extending from the first duct and terminating at a first opening and forming a second conduit in the second structure. The second conduit extends from the second duct and terminates at a second opening with each of the first structure and the second structure being inter-disposed in a pre-determined configuration one of prior to and during forming of the first conduit and the second conduit. The second conduit extends from the second duct and terminates at a second opening with each of the first conduit and the second conduit being shaped and dimensioned for generating a nozzle-type flow therethrough. The first duct is for receiving fluid thereinto and for directing the fluid to the first conduit for discharge through the first opening and the second duct is for receiving fluid thereinto and for directing the fluid to the second conduit for discharge through the second opening. A cutting blade for cutting a work-piece is disposable between the first structure and the second structure. The fluid discharged by the first conduit and the second conduit is directed towards at least one of a portion of the work-piece and two directly outwardly opposing surface portions of the cutting blade. Direction of discharge of the fluid from the first conduit and second conduit is determined by position and orientation of each of the first conduit and the second conduit. The position and orientation of the first conduit with reference to the position and orientation of the second conduit is determined during forming of the first conduit and the second conduit in the first structure and the second structure.

In accordance with a seventh aspect of the invention, there is disclosed a fluid discharge apparatus comprising a structure defining a duct and a plurality of conduits therein. Each of the plurality of conduits extends from the duct and terminates at an opening formed in the structure with at least one of the plurality of conduits being shaped and dimensioned for generating a nozzle-type flow therethrough. The structure is disposable adjacent at least one of a work-piece and a cutting blade for cutting the work-piece. The duct is for receiving fluid thereinto and for directing the fluid to the plurality of conduits for discharge through the opening of at least one of the plurality of conduits. The fluid is directed by the first conduit and the second conduit towards at least one of a portion of the work-piece and two directly outwardly opposing surface portions of the cutting blade. Direction of discharge of the fluid from the first conduit and second conduit is determined by position and orientation of each of the first conduit and the second conduit, and the position and orientation of each of the first conduit and the second conduit is determined prior to forming of the first conduit and the second conduit in the first structure and the second structure.

BRIEF DESCRIPTION OF THE DRAWINGS

The novel features of the invention are set forth in the appended claims. However, for purpose of explanation, several embodiments of the invention are set forth in the following figures.

DETAILED DESCRIPTION

In the following description, numerous details and alternatives are set forth for purpose of explanation. However, one of ordinary skill in the art will realize that the invention can be practiced without the use of these specific details. In other instances, well-known structures and devices are shown in block diagram form in order not to obscure the description of the invention with unnecessary detail. For example, it is commonly known in the art of semiconductor device assembly that assembly is generally done on a matrix array of leadframes, often referred to as leadframe strips. Each strip has a plurality of individual positions that will all be processed in the same way through various steps to form individual packaged semiconductor devices. A position can have one or more semiconductor die within.

Additional information on leadframe strips as described in the present invention can be found in the related U.S. patent application Ser. No. 11/788,496 filed Mar. 19, 2007, entitled "MOLDED LEADFRAME SUBSTRATE SEMICONDUCTOR PACKAGE," the entirety of which is hereby incorporated by reference.

In an exemplary embodiment of the invention, a semiconductor singulation cooling system or a fluid discharge apparatus 20 is described with reference to FIG. 5 through FIG. 10. The fluid discharge apparatus 20 is used in conjunction with one of a singulation system and a dicing system. Singulation is typically performed by using a dicing saw to make cuts along the edges of semiconductor packages where the package is singulated from a molded sheet (or strip) of packages by using a singulation procedure. Singulation is performed differently in different embodiments. For example, some embodiments perform singulation by punching, while some embodiments perform dicing. Dicing includes sawing with a blade and/or cutting with a laser. Some embodiments employ a conventional dicing saw for the singulation step. Singulation is generally discussed in the co-owned U.S. Patent Application No. 60/792,093, filed Apr. 13, 2006, and entitled "METHOD AND APPARATUS FOR HIGH SPEED SINGULATION," which is incorporated herein by reference in its entirety.

Figure 1:
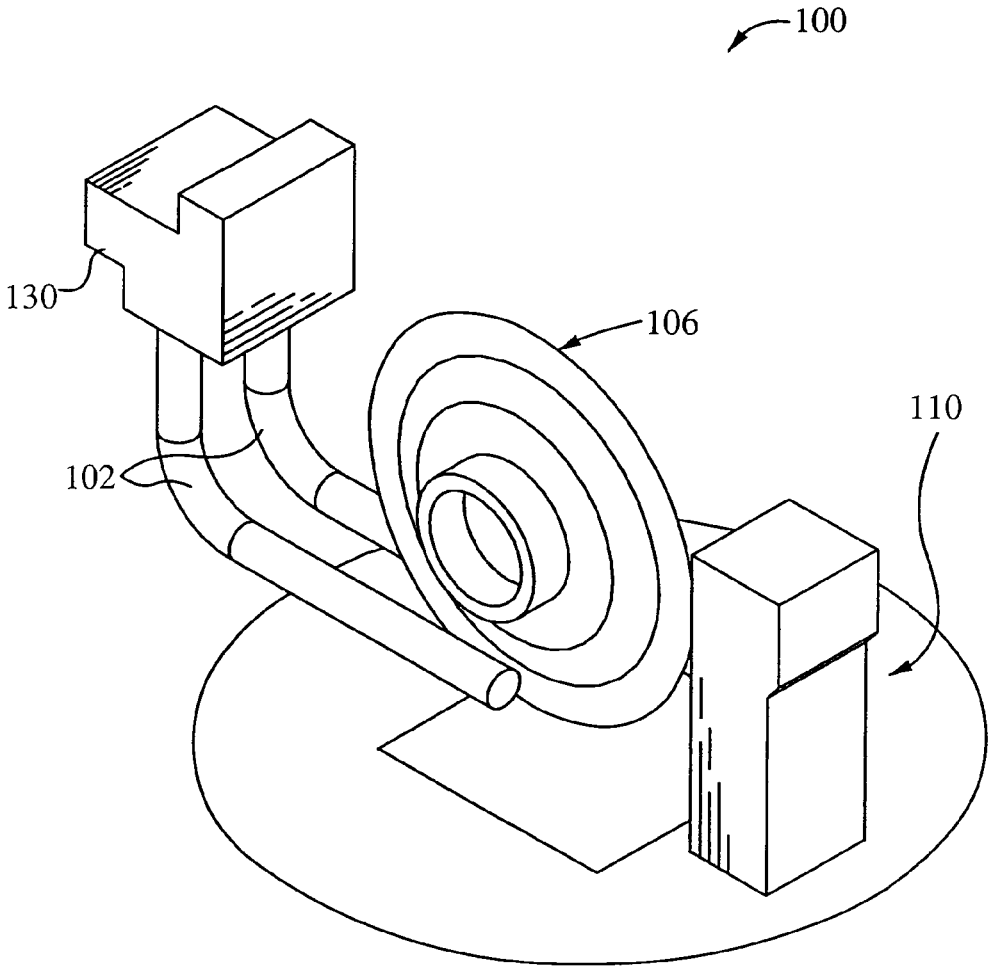
Fig. 1 (Prior Art)
FIG. 1 shows a perspective view of a prior art semiconductor singulation cooling system.
Figures 2, 2A:
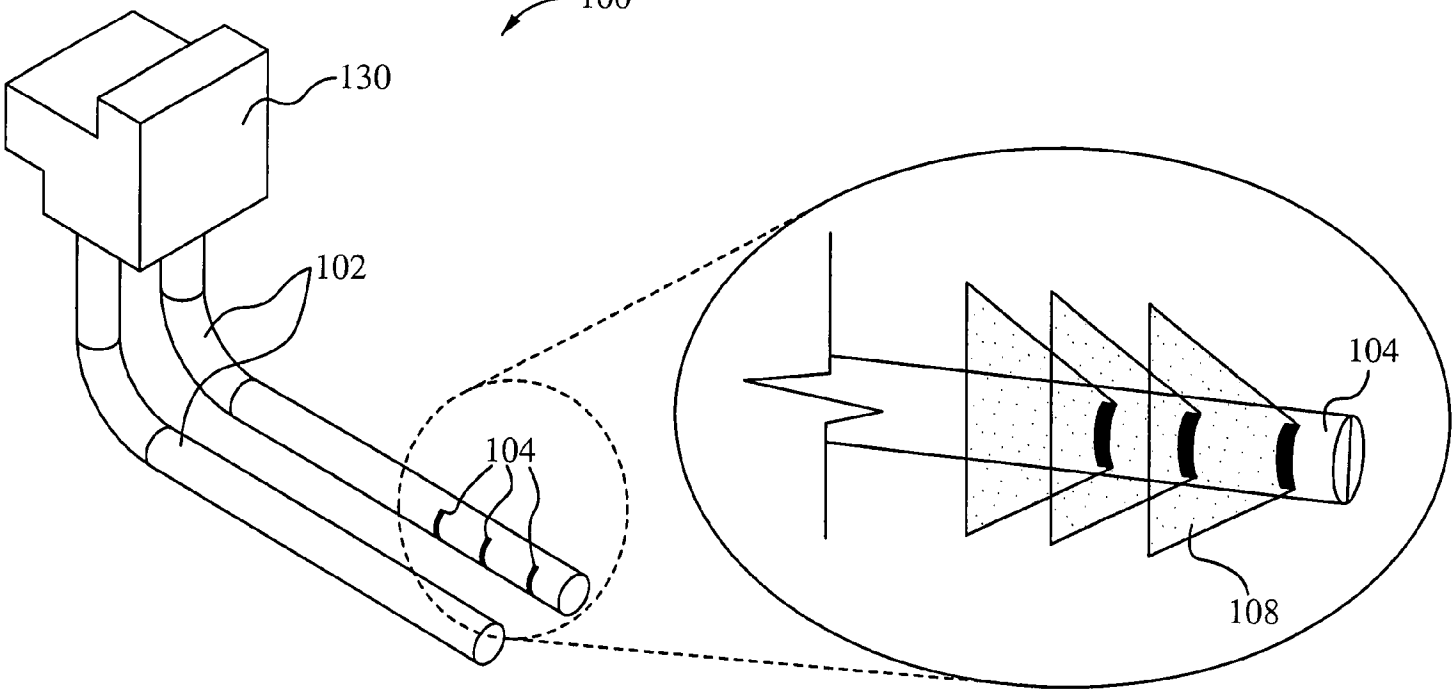
Fig. 2 (Prior Art)
Fig. 2A (Prior Art)
FIGS. 2 and 2A show a perspective view of a prior art side blade cooling nozzle.
Figure 3:
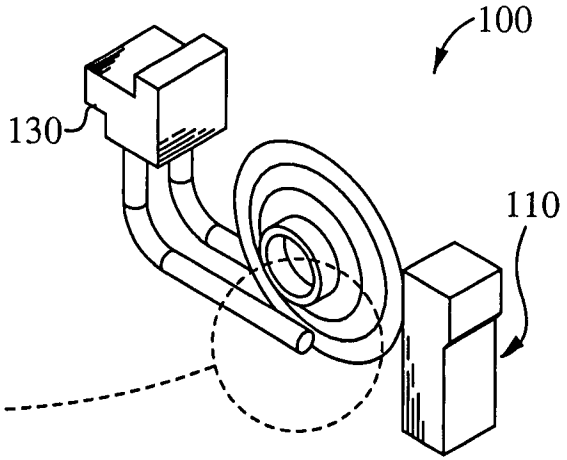
Fig. 3 (Prior Art)
FIG. 3 shows a perspective view of a prior art semiconductor singulation cooling system.
Figure 3A:
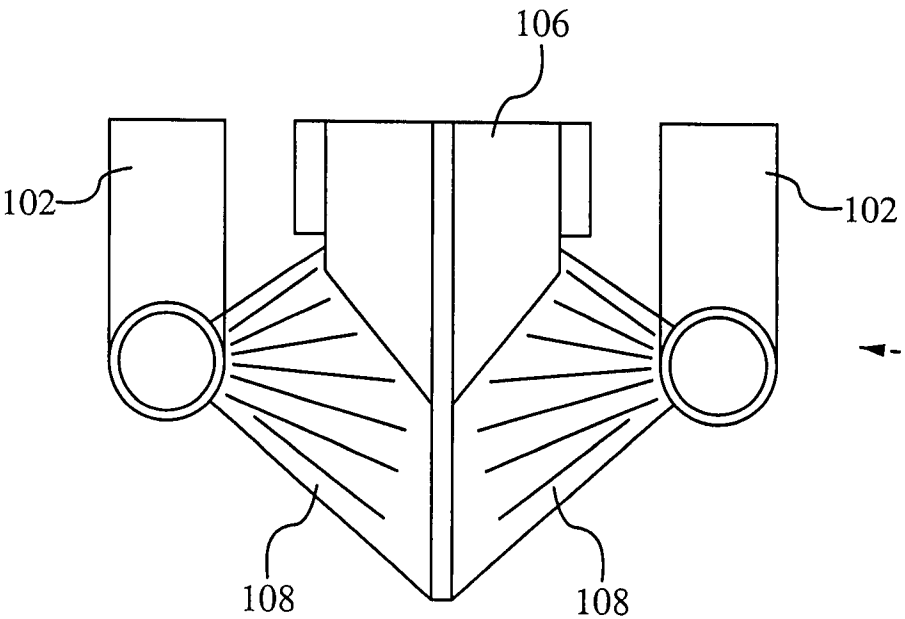
Fig. 3A (Prior Art)
FIG. 3A shows a front view of a prior art side blade cooling nozzle.
Figure 4A:
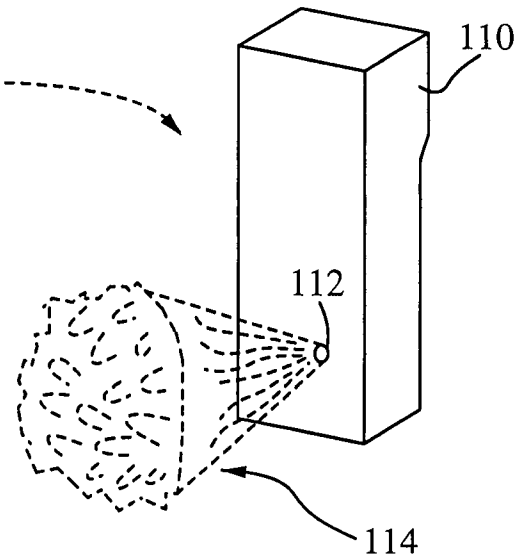
Fig. 4A (Prior Art)
FIG. 4A shows a perspective view of a prior art center blade cooling nozzle.
Figure 4:
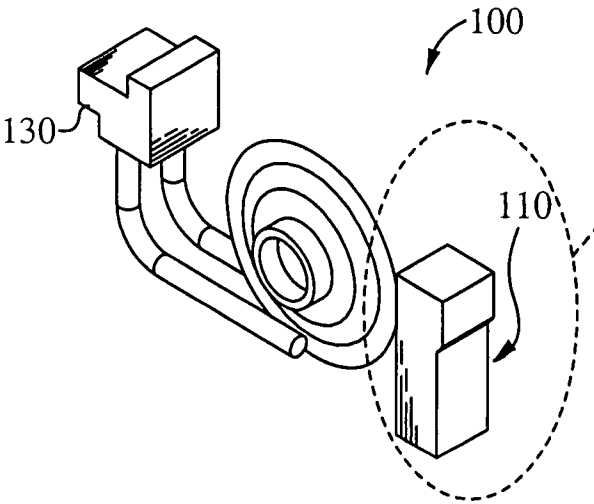
Fig. 4 (Prior Art)
FIG. 4 shows a perspective view of a prior art semiconductor singulation cooling system.
Figure 5:
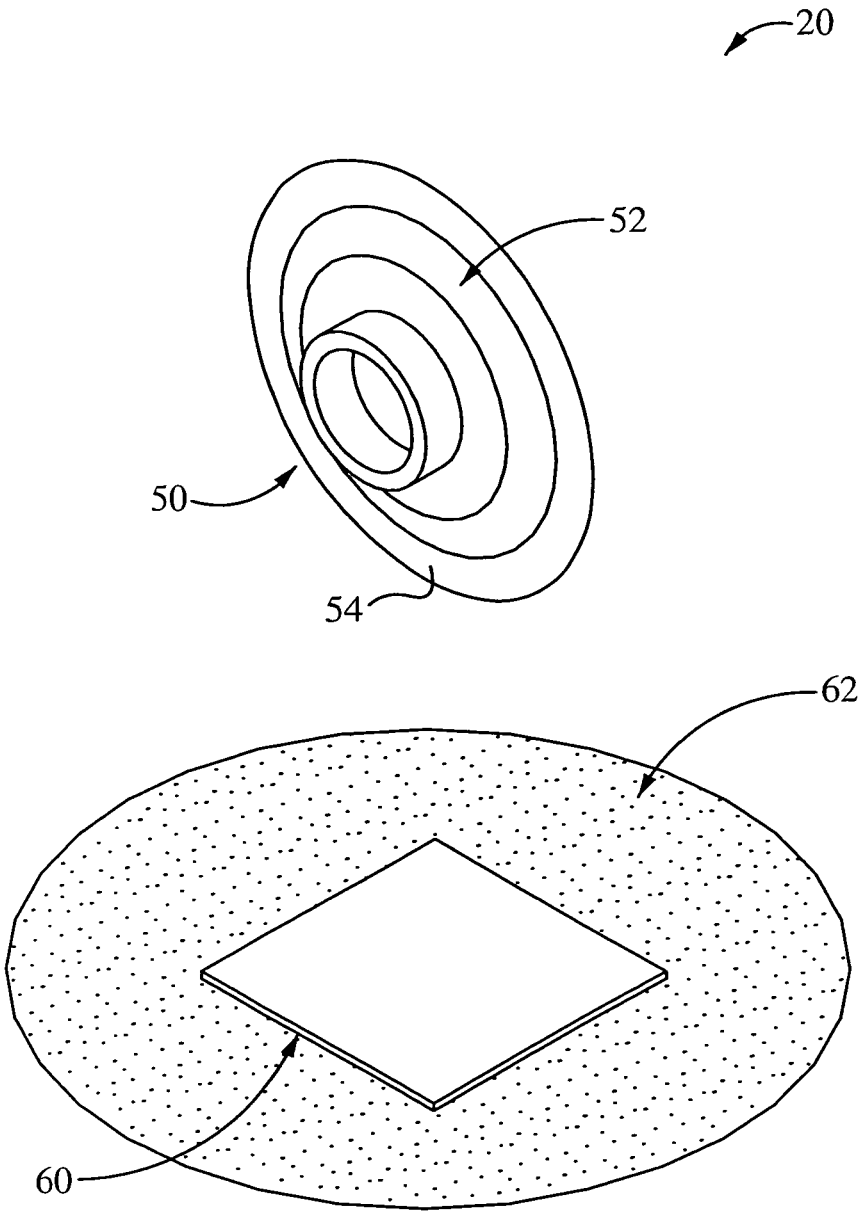
FIG. 5 shows a perspective view of a cutting blade and work-piece according to an embodiment of the current invention.
Figure 6:
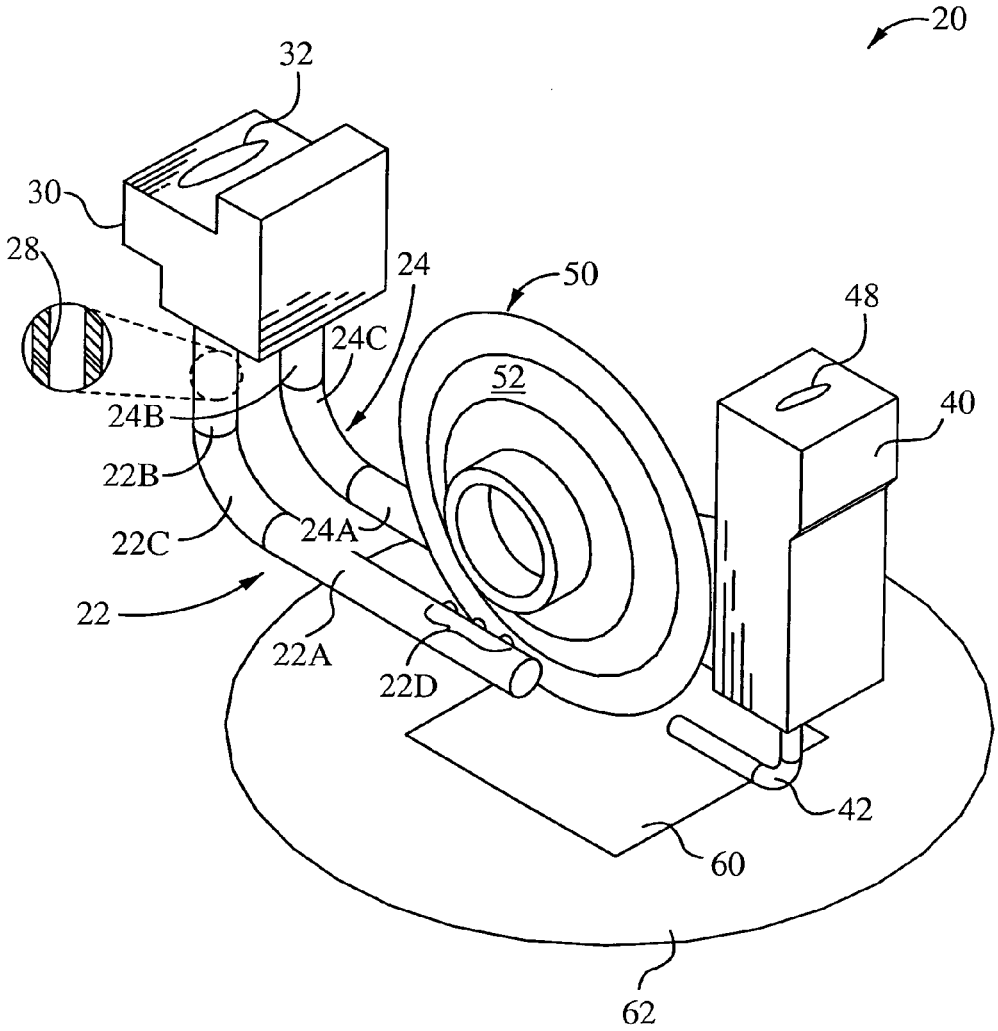
FIG. 6 shows a perspective view of a semiconductor singulation cooling system according to an embodiment of the current invention.
Figure 7A:
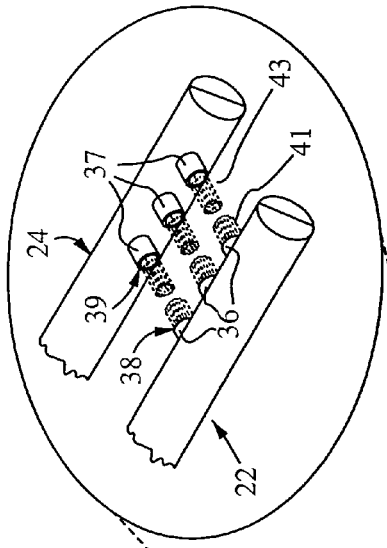
FIGS. 7, 7A and 7B show a perspective view of a cooling nozzle structure according to an embodiment of the current invention.
Figure 7B:
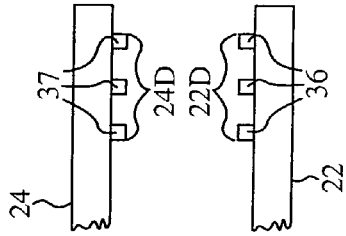
Figure 7:
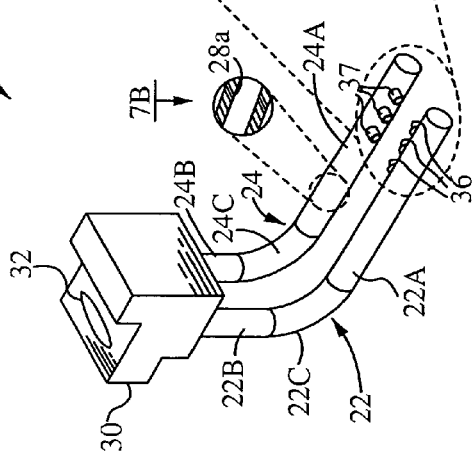

In an example, a saw jig with a rubber pad support (both not shown) is used for supporting a work-piece 60 (FIG. 5). The work-piece 60 is one of a semiconductor package and a semiconductor substrate. For example, the work-piece 60 consists of quad-flat no-lead (QFN) packages. Vacuum generated through vacuum holes formed in the rubber pad secures the work-piece 60 to the saw jig both during and after sawing of the work-piece 60. In some embodiments, the work-piece 60 is supported on a dicing tape 62. The dicing tape 62 is typically an adhesive (dicing) tape that is used in a manufacturing process of the semiconductor packages. The dicing tape 62 can be applied to one side of the molded sheet of packages before an encapsulation is applied to the dice mounted on leadframes. The encapsulation is typically performed by molding a plastic resin to the sheet of dice and leadframes. In these cases, the dicing tape 62 provides a lower support structure for the formation of the plastic molding during encapsulation. Further, the dicing tape facilitates securing the work-piece 60 during and after sawing of the work-piece 60.

A conventional saw is used for sawing the work-piece 60. The saw has a cutting blade 50 that is substantially planar, disc-shaped and has a blade flange 52 and a periphery 54. The saw is coupled to a spindle (not shown) that transmits rotational displacement thereto. During a sawing process, the cutting blade 50 rotates at a substantially high rotational (spindle) speed. In some embodiments, the spindle speed of the cutting blade 50 is approximately 30,000 to 50,000 rotations per minute (RPM).

As shown in FIG. 5 to FIG. 8, the fluid discharge apparatus 20 comprises a first structure 22 having a first portion 22A, a second portion 22B and a rounded portion 22C joining the first and second portion 22A, 22B. The first portion 22A, the second portion 22B and the rounded portion 22C are cylindrically shaped and inter-configured to form an L-shape, with a rounded corner. Alternatively, the first structure 22 can be of any geometrical shape. The first structure 22 comprises a duct 28 formed therein extending from the first portion 22A, the rounded portion 22C to the second portion 22B thereof and terminating at an inlet 32.

The first structure 22 comprises a first section 22D extending along the first portion 22A of the first structure 22. The first section 22D is parallel to the length of the first portion 22A of the first structure 22. Conduits 36 (FIG. 7) formed in the first structure 22 extend towards and terminate at openings 38 formed on the first section 22D. Each of the conduits 36 has a uniform cross-sectional shape along the length thereof. Alternatively, the conduits 36 do not have a uniform length-transverse cross-sectional shape. Each of the conduits 36 has a circular length-transverse cross-sectional shape. Alternatively, the length-transverse cross-sectional shape of each of the conduits 36 has a non-circular geometrical shape.

The inlet 32 of the fluid discharge apparatus 20 is coupled to a fluid supply source (not shown). The fluid supply source can be coupled to a reservoir (not shown). The reservoir typically stores a fluid. In some embodiments, a chiller module is coupled between the reservoir and the inlet 32. The chiller module can receive the fluid from the reservoir and chill or cool it. Fluid receivable by the fluid discharge apparatus 20 includes liquids, inert gases and deionised (DI) water. In some embodiments, the fluid can be a synthetic lubricant. Alternatively, a gas-liquid mixture is carried through the duct 28 of the fluid discharge apparatus 20. Further, the fluid discharge apparatus 20 comprises more than one of the duct 28 with each thereof for carrying one of a gas and a liquid inter-directable for mixing prior to or when being discharged from the fluid discharge apparatus 20.

Preferably, DI water is supplied by the fluid supply source to the fluid discharge apparatus 20. A pump (not shown) displaces fluid from the fluid supply source towards a manifold (not shown) which then distributes the fluid to the fluid discharge apparatus 20. A valve (not shown) inter-couples the manifold and the fluid discharge apparatus 20 for regulating the flow rate of the fluid delivered to the fluid discharge apparatus 20.

When fluid is received by the duct 28 through the inlet 32 of the fluid discharge apparatus 20, the duct 28 directs the fluid to the conduits 36 for discharge through the openings 38 as fluid streams 41. Each of the conduits 36 is dimensioned for generating a nozzle-type flow therethrough. Specifically, a nozzle-type flow is created through the conduits 36 when each of the conduits 36 is of a sufficient length. The nozzle-type flow differs from an orifice-type flow in that the orifice-type flow is created when there is insufficient distance between the duct 28 and the openings 38. The orifice-type flow results in fluid being discharged in a dispersed manner at the openings 38. Additionally, for a pre-determined flow pressure through the conduits 36, the dimensions of the each of the conduits 36 can be varied for varying the flow characteristics therethrough.

Figure 8:
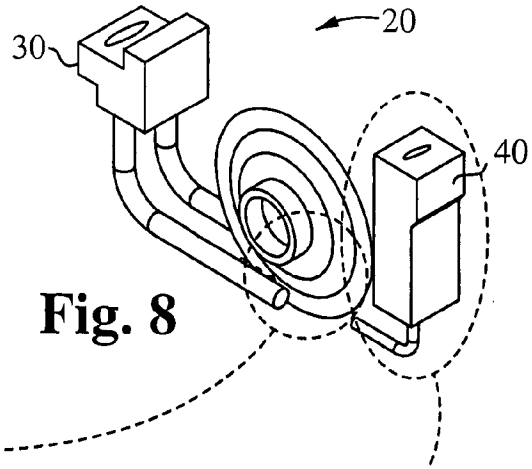
FIG. 8 shows a perspective view of the semiconductor singulation cooling system according to an embodiment of the current invention.
Figure 8B:
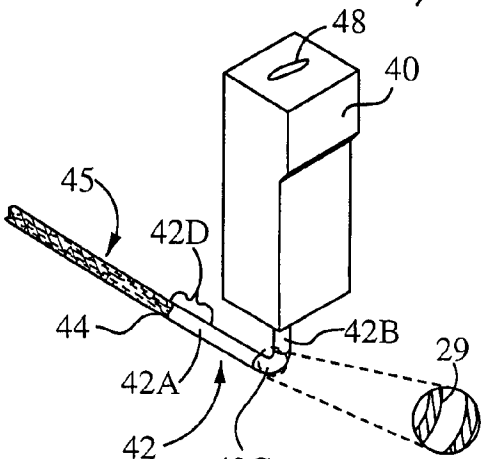
FIG. 8B shows a perspective view of another cooling nozzle structure according to an embodiment of the current invention.
Figure 8A:
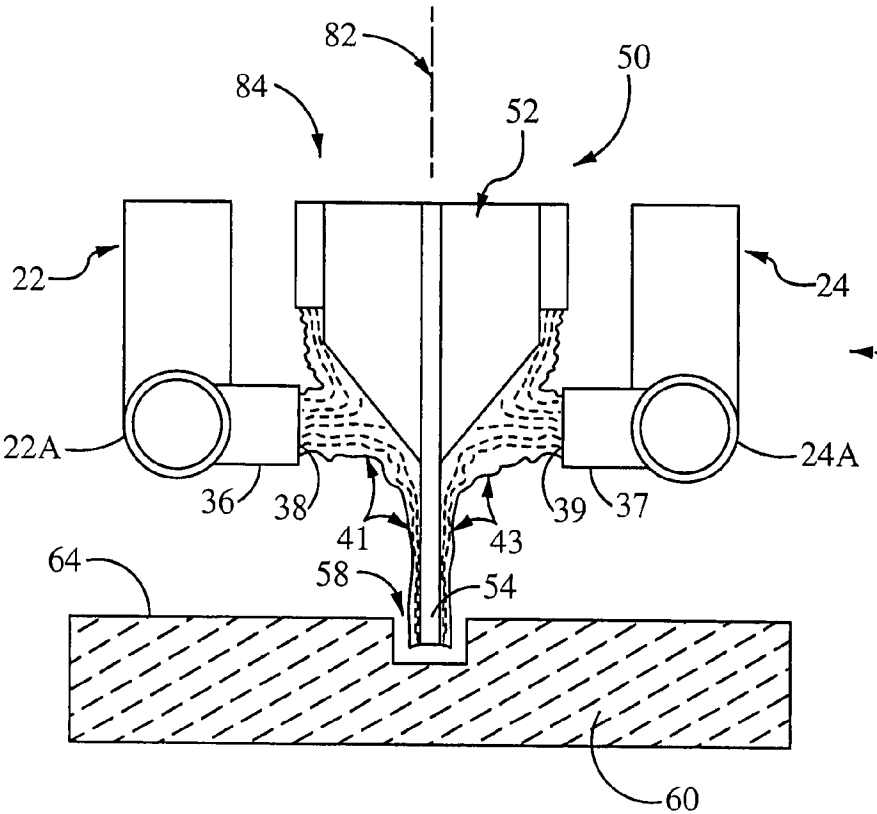
FIG. 8A shows a front view of a cooling nozzle structure according to an embodiment of the current invention.

The fluid discharge apparatus 20 further comprises a second structure 24 being a symmetrical structure of the first structure 22 about a reference plane 82 (FIG. 8A). The second structure 24 comprises a first portion 24A, a second portion 24B and a rounded portion 24C joining the first and second portion 24A, 24B having symmetrical structural configurations and positional relationships of the first portion 22A, the second portion 22B and the rounded portion 22C. The second structure 24 comprises a duct 28*a* formed therein extending from the first portion 24A, the rounded portion 24C to the second portion 24B thereof and terminating at the inlet 32. Further, the second structure 24 comprises a second section 24D, conduits 37 and openings 39 having symmetrical structural configurations and positional relationships of the first section 22D, the conduits 36 and the openings 38 of the first structure 22 about the reference plane 82.

The second structure 24 is spatially displaced from the first structure 22 to form a gap 84 therebetween. A mounting structure 30 couples the first structure 22 to the second structure 24 with the first section 22D of the first structure 22 opposing the second section 24D of the second structure 24.

The fluid discharge apparatus 20 further comprises a third structure 42 being a structure similar of the first and second structure 22, 24 and disposed about a plane coincident with the reference plane 82. The third structure 42 (FIG. 8B) comprises a first portion 42A, a second portion 42B and a rounded portion 42C joining the first and second portion 42A, 42B. The first portion 42A, the second portion 42B and the rounded portion 42C are cylindrically shaped and inter-configured to form an L-shape, with a rounded corner. Alternatively, the third structure 42 can be of any geometrical shape. The third structure 42 comprises a duct 29 formed therein extending from the first portion 42A, the rounded portion 42C to the second portion 42B thereof and terminating at an inlet 48.

The third structure 42 comprises a third section or conduit 42D extending along the first portion 42A of the third structure 42. The conduit 42D extends toward and terminates at opening 44 formed on the first portion 42A. The conduit 42D acts similar as the conduits 36, 37. The conduit 42D has a uniform cross-sectional shape along the length thereof. Alternatively, the conduit 42D does not have a uniform length-transverse cross-sectional shape. The conduit 42D has a circular length-transverse cross-sectional shape. Alternatively, the length-transverse cross-sectional shape of the conduit 42D has a non-circular geometrical shape. The opening 44 is configured to face towards the cutting blade 50. A center blade mounting structure 40 couples with the third structure 42 and includes the inlet 48.

The inlet 48 of the fluid discharge apparatus 20 is coupled to a fluid supply source (not shown) similar as described above, which can include a reservoir and a chiller module. In some embodiments the inlets 32, 48 can be coupled to the same fluid supply source. Alternatively, a separate fluid supply source is coupled to each of the inlet 32 and the inlet 48.

Beside being directed at a cutting area, one or more of the conduits 36, 37, 42D are positioned and orientated for directing fluid streams to other portions of the work-piece 60 and cutting blade 50 for cooling thereof and for washing away of debris therefrom. Therefore, the openings 38, 39, 44 are not limited to being formed only on the first, second and third sections 22D, 24D, 42D of the first, second and third structure 22, 24, 42.

The work-piece 60 has a surface 64 and a cut path along which the cutting blade 50 traverses and interacts with the work-piece 60 at a cutting area 58 for sawing thereof. The cutting blade 50 rotates about an axis that is substantially parallel to the surface 64 of the work-piece 60.

Figure 9:
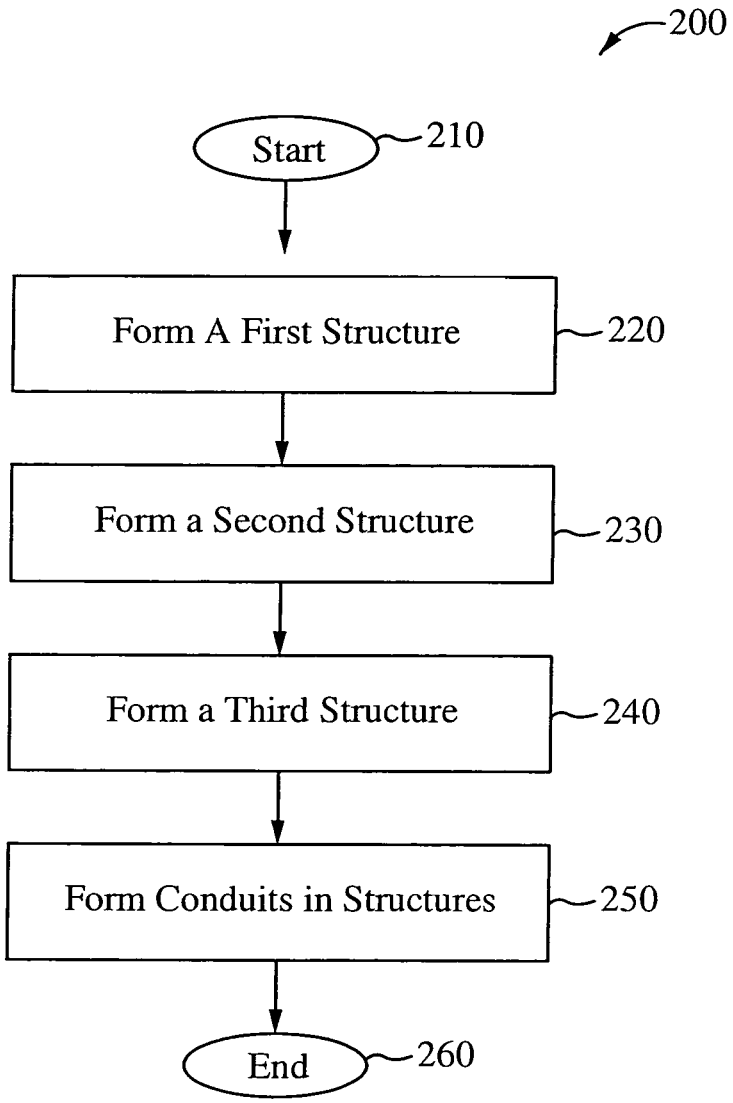
FIG. 9 shows a process flow diagram of a method of forming a semiconductor singulation cooling system according to an embodiment of the current invention.

FIG. 9 shows an exemplary embodiment of a method 200 of forming the fluid discharge apparatus 20. In one instance of the embodiment, the fluid discharge apparatus 20 can be fabricated by machining. The method begins at the step 210. At the step 220, for example, the first structure 22 is fabricated on a milling machine including the forming of the duct 28. Fabricating with a milling machine by a combination of cutters enable high dimensional control of the shape, size and position of the duct 28. At the step 230, the second structure 24 is fabricated on a milling machine by a combination of cutters similar as described above for forming the first structure 22. Similarly, at the step 240, the third structure 42 is fabricated on a milling machine by a combination of cutters. The step 250, the milling machine is used to form the conduits 36, 37, 42D and the openings 38, 39, 44 in the first, second and third structure 22, 24, 42. Using a milling machine substantially ensures high manufacturing repeatability of dimensions and relative positions of elements of the fluid discharge apparatus 20, for example, the ducts 28, 28*a*, 29, the openings 38, 39, 44 and the conduits 36, 37, 42D. The fluid discharge apparatus 20 is made from aluminum. Alternatively, other types of material are useable in fabricating the fluid discharge apparatus 20. At the step 260, the method 200 ends. Alternatively, the fluid discharge apparatus 20 can be fabricated by one of casting and plastic molding.

When the fluid discharge apparatus 20 is used with the saw jig and the saw for singulating the work-piece 60, the cutting blade 50 is received through the gap 84 and positioned in coincidence with the reference plane 82.

During cutting of the work-piece 60 by the cutting blade 50, heat is generated at the cutting area 58 and on the cutting blade 50. Ineffective cooling of the cutting area 58 results in many undesirable problems including a low quality of cut. Additionally, ineffective cooling of the cutting area 58 limits cutting speed of the saw. This consequently translates into lower production yield.

The first and second sections 22D, 24D and the third section 42D enable the conduits 36, 37, 42D of the fluid discharge apparatus 20 to be disposed substantially close to the cutting blade 50 and the surface 64 of the work-piece 60. This enables one or more of the openings 38, 39, 44 on the first, second and third sections 22D, 24D, 42D to be positioned for directing the fluid streams 41, 43, 45 substantially towards the cutting area 58. The cutting area 58 defines an area whereat the cutting blade 50 and the work-piece 60 interact. The cutting area 58 comprises one or more of a portion of the cutting blade 50 and a portion of the work-piece 60. Additionally, as the conduits 36, 37, 42D are fabricated by machining, the openings 38, 39, 44 can be positioned in a curve along the first, second and third sections 22D, 24D, 42D to conform to the curvature of the periphery 54 of the cutting blade 50. For example, the openings 36 can be formed along on the first section 22D of the first structure 22 along a curve. This enables the fluid streams 41 to also be substantially delivered to the periphery 54 of the cutting blade 50 whereat heat is concentrated.

The openings 38, 39 of both the first and second structures 22, 24 are pre-aligned during fabrication of the fluid discharge apparatus 20 for substantially coinciding the longitudinal axis of each of the conduits 36 of the first structure 22 with a corresponding conduit 37 of the second structure 24. Alternatively, the openings 38 of the first structure 22 are aligned with the conduits 36 thereof having an orientation and position that is symmetrical with the orientation and position of the conduits 37 of the second structure 24 about the reference plane 82. This substantially ensures that surface portions on one side of the cutting blade 50 whereat fluid streams 41 from the first structure 22 are directed, positionally aligns with surface portions on the other side of the cutting blade 50 whereat fluid streams 43 from the second structure 24 are directed to thereby align and balance the forces created by the fluid streams 41, 43 on both sides of the cutting blade 50.

Deflection of the cutting blade 50 occurs when forces from the water streams 41, 43 are not balanced. When the cutting blade 50 is being rotated at a high speed, deflection thereof results in vibrations created by imbalance of forces created by the water streams 41, 43 on the cutting blade 50, translating into low quality cuts of the work-piece 60.

As described above, the fluid discharge apparatus 20 can be fabricated by machining of a single block of metal, for example, by milling operations on a block of aluminum. However, alternatively, the first structure 22, second structure 24 and the mounting structure 30 can be fabricated as separate components to be subsequently assembled. Further, the third structure 42 and the center blade mounting structure 40 can be fabricated as separate components to be subsequently assembled.

Figure 10:
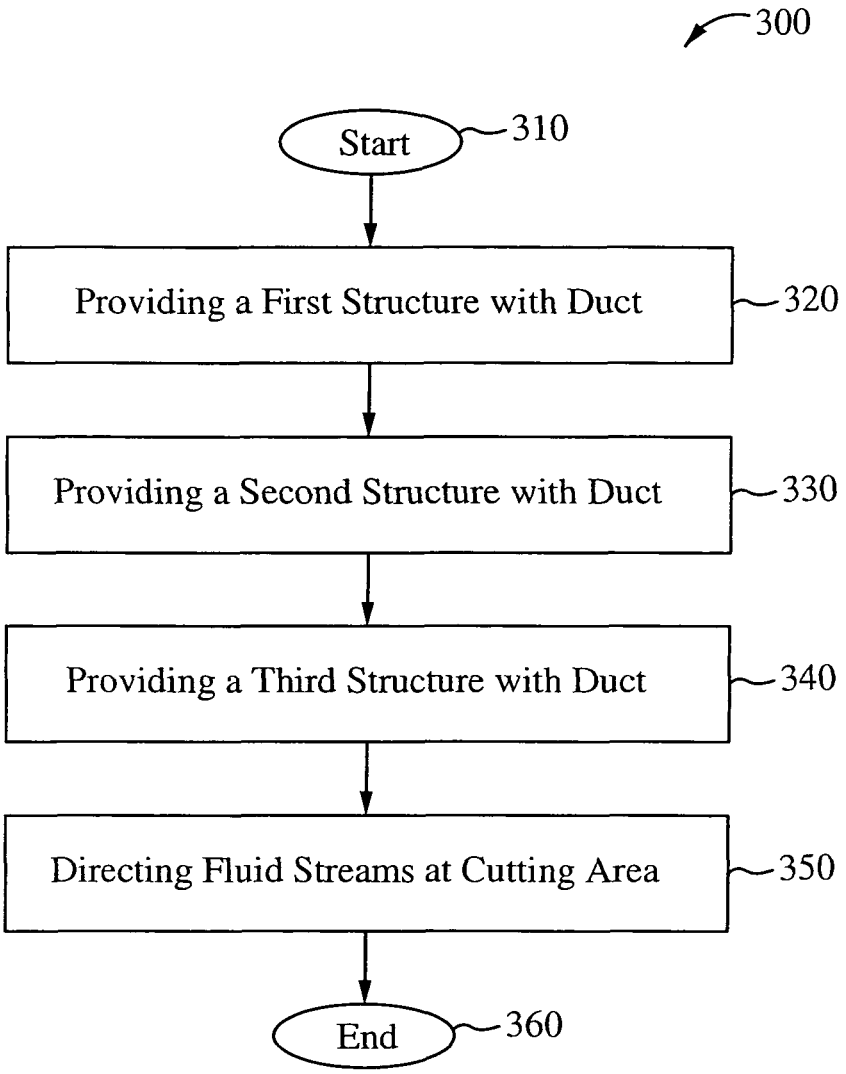
FIG. 10 shows a process flow diagram of a fluid discharge method according to an embodiment of the current invention.

FIG. 10 shows a process flow diagram of a method 300 of aligning directions of discharge of fluid streams onto a cutting area. The method 300 begins at the step 310. At the step 320, the first structure 22 defining the duct 28 therein is provided. The first structure 22 further defines the conduits 36 extending from the duct 28 and terminating at the openings 38. At the step 330, the second structure 24 defining the duct 28*a* therein is provided. The second structure 24 further defines the conduits 37 extending from the duct 28*a* and terminating at the openings 39. At the step 340, the third structure 42 defining the duct 29 therein is provided. The third structure 42 further defines the conduits 42D extending from the duct 29 and terminating at the openings 44. Each of the conduits 36, 37, 42D can be shaped and dimensioned for generating a nozzle-type flow therethrough. The first structure 22 is spatially displaced from the second structure 24. The duct 28 is for receiving fluid thereinto and for directing the fluid to the conduit 36 for discharge through the openings 38 as the fluid stream 41. The duct 28*a* is for receiving fluid thereinto and for directing the fluid to the conduit 37 for discharge through the openings 39 as the fluid stream 43 and the duct 29 is for receiving fluid thereinto and for directing the fluid to the conduit 42D for discharge through the opening 44 as the fluid stream 45. The cutting blade 50 for cutting the work-piece 60 is disposed between the first structure 22 and the second structure 24.

At the step 350, fluid streams 41, 43, 45 can be discharged onto the cutting area 58. The cutting area 58 can be at least one of a portion of the work-piece 60 and two directly outwardly opposing surface portions of the cutting blade 50. The discharge direction of the fluid stream 45 is aligned with the cutting area 58. The discharge direction of the fluid streams 41, 43, 45 can be determined by position and orientation of each of the conduits 36, 37, 42D. The position and orientation of the conduits 36 with reference to the position and orientation of the conduits 37 can be determined during forming of the conduits 36, 37.

Figure 11:
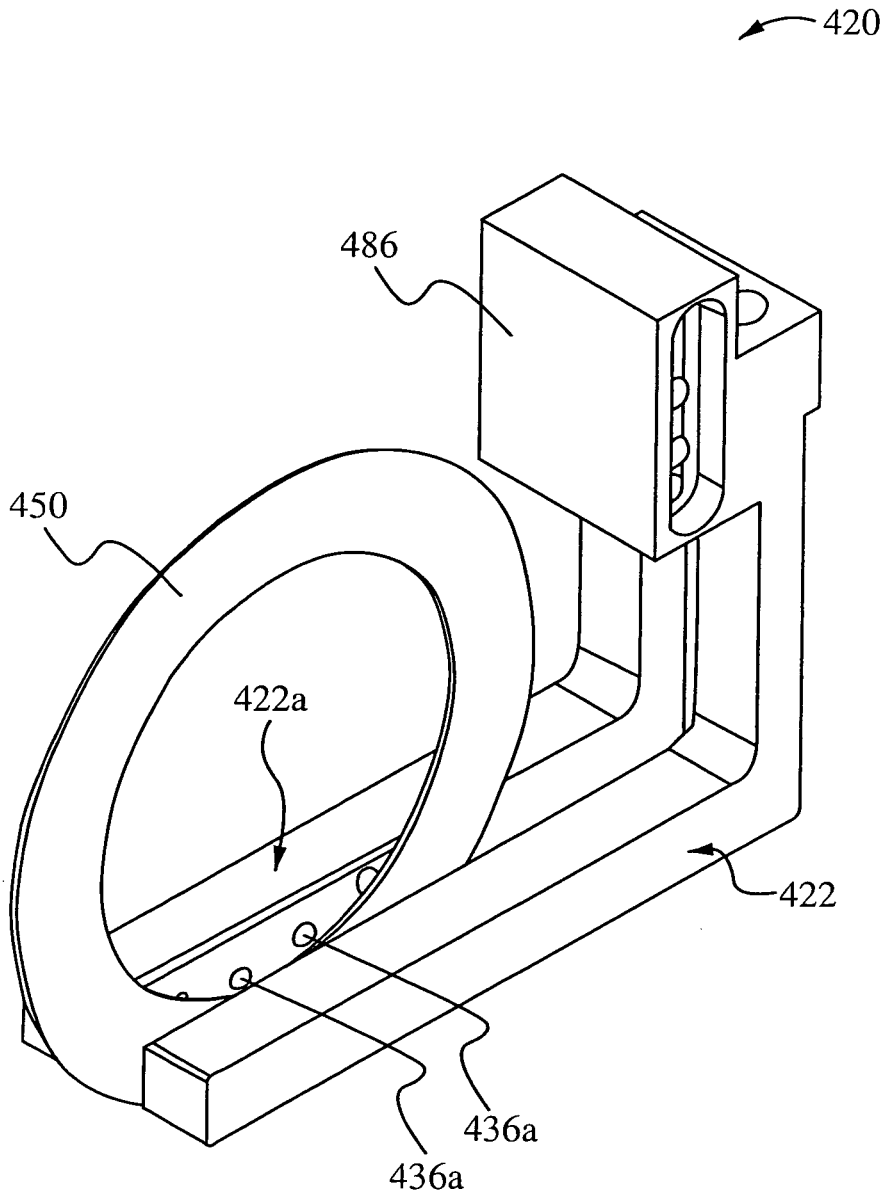
FIG. 11 shows a perspective view of a semiconductor singulation cooling system according to another embodiment of the current invention.
Figure 12:
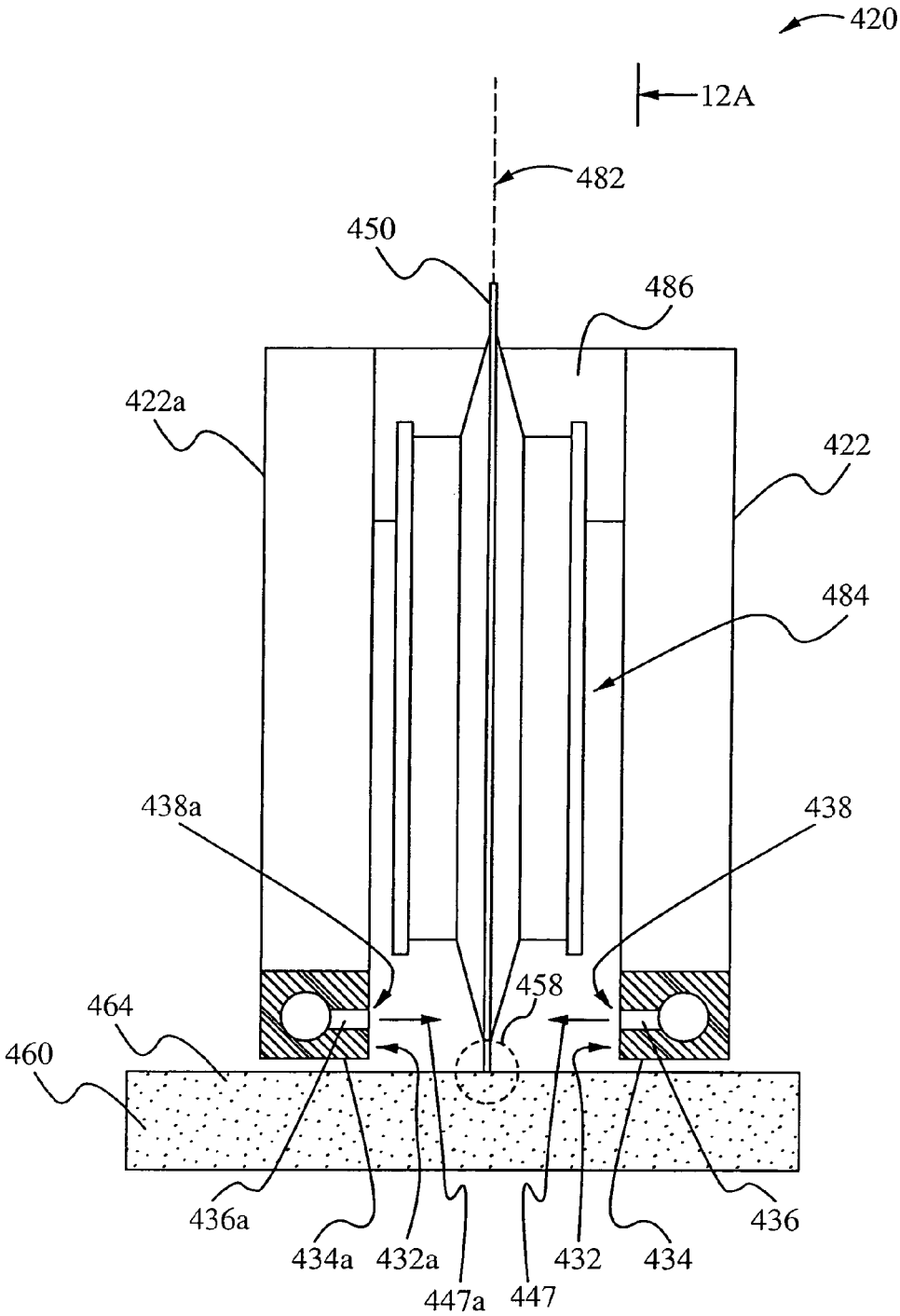
FIG. 12 shows a front view of a semiconductor singulation cooling system according to another embodiment of the current invention.
Figure 12A:
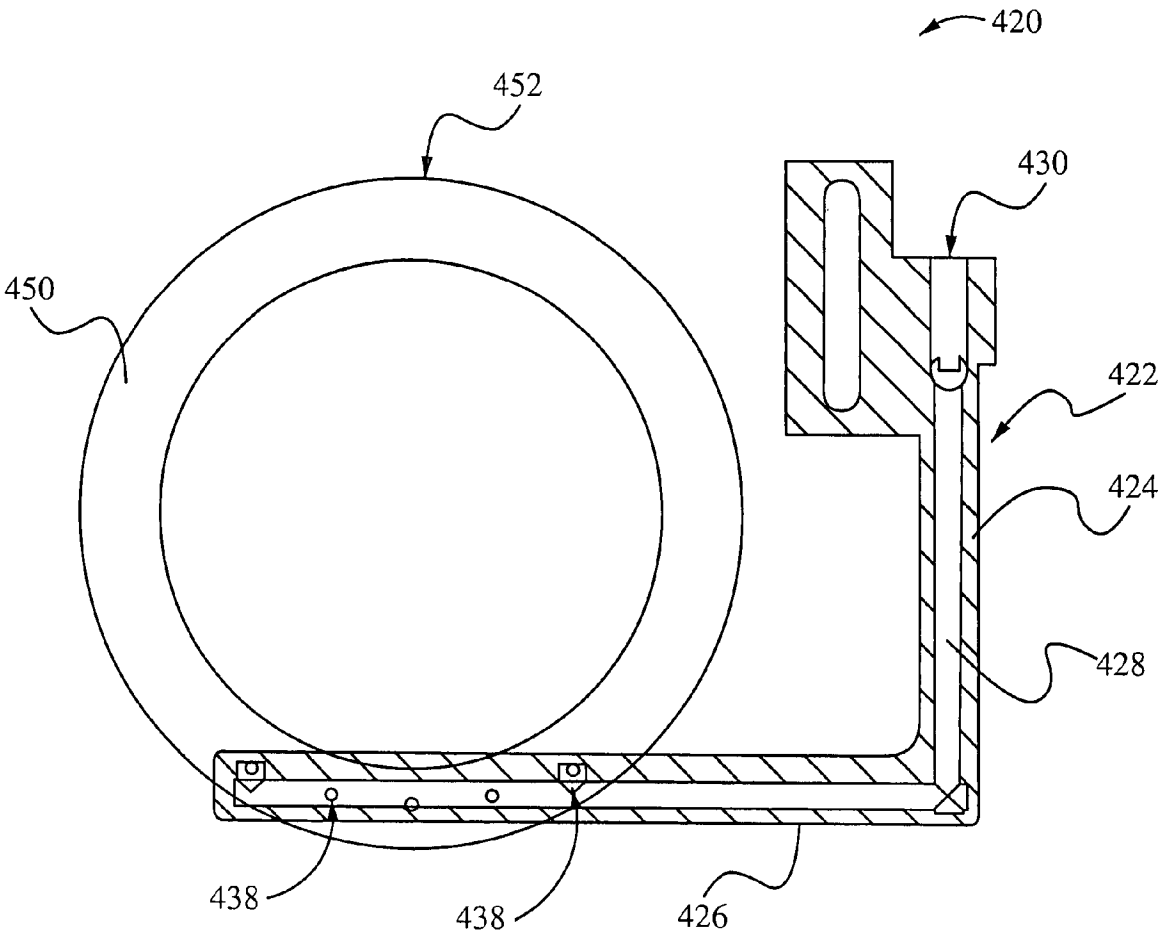
FIG. 12A shows a side partial view of a semiconductor singulation cooling system according to another embodiment of the current invention.

FIGS. 11, 12 and 12A show a semiconductor singulation cooling system or a fluid discharge apparatus 420 according to an alternative embodiment of the invention. The fluid discharge apparatus 420 comprises a first structure 422 having a first portion 424 and a second portion 426. The first portion 424 and the second portion 426 are rectilinearly shaped and inter-configured to form an L-shape. Alternatively, the first structure 422 can be of any geometrical shape. The first structure 422 has a duct 428 formed therein extending from the first portion 424 to the second portion 426 thereof and terminating at an inlet 430.

The first structure 422 comprises a first face 432 and a second face 434 extending along the first portion 424 of the first structure 422. The first face 432 is parallel to the length of the second portion 426 of the first structure 422. The second face 434 is substantially perpendicular to the first face 432 and faces away from the second portion 426 of the first structure 422. Conduits 436 formed in the first structure 422 extend towards and terminate at openings 438 formed on the first face 432. Each of the conduits 436 has a uniform cross-sectional shape along the length thereof. Alternatively, the conduits 436 do not have a uniform length-transverse cross-sectional shape. Each of the conduits 436 has a circular length-transverse cross-sectional shape. Alternatively, the length-transverse cross-sectional shape of each of the conduits 436 has a non-circular geometrical shape.

The inlet 430 of the fluid discharge apparatus 420 is coupled to a fluid supply source (not shown). Fluid receivable by the fluid discharge apparatus 420 includes liquids, inert gases and deionised (DI) water. In some embodiments, the fluid can be a synthetic lubricant. Alternatively, a gas-liquid mixture is carried through the duct 428 of the fluid discharge apparatus 420. Further alternatively, the fluid discharge apparatus comprises more than one of the duct 428 with each thereof for carrying one of a gas and a liquid inter-directable for mixing prior to or when being discharged from the fluid discharge apparatus 420.

Preferably, DI water is supplied by the fluid supply source to the fluid discharge apparatus 420. A pump (not shown) displaces fluid from the fluid supply source towards a manifold (not shown) which then distributes the fluid to the fluid discharge apparatus 420. A valve (not shown) inter-couples the manifold and the fluid discharge apparatus 420 for regulating the flow rate of the fluid delivered to the fluid discharge apparatus 420.

When fluid is received by the duct 428 through the inlet 430 of the fluid discharge apparatus 420, the duct 428 directs the fluid to the conduits 436 for discharge through the openings 438 as fluid streams 447. Each of the conduits 436 is dimensioned for generating a nozzle-type flow therethrough. Specifically, a nozzle-type flow is created through the conduits 436 when each of the conduits 436 is of a sufficient length. The nozzle-type flow differs from an orifice-type flow in that the orifice-type flow is created when there is insufficient distance between the duct 428 and the openings 438. The orifice-type flow results in fluid being discharged in a dispersed manner at the openings 438. Additionally, for a predetermined flow pressure through the conduits 436, the dimensions of the each of the conduits 436 can be varied for varying the flow characteristics therethrough.

Beside being directed at the cutting area, one or more of the conduits 436, 436*a* are positioned and orientated for directing fluid streams to other portions of the work-piece 460 and cutting blade 450 for cooling thereof and for washing away of debris therefrom. Therefore, the openings 438, 438*a* are not limited to being formed only on the first faces 432, 432*a* of the first structure 422 and the second structure 422*a*.

The fluid discharge apparatus 20 further comprises a second structure 422*a* being a symmetrical structure of the first structure 422 about a reference plane 482. The second structure 422*a* comprises a first face 432*a*, a second face 434*a*, conduits 436*a* and openings 438*a* having symmetrical structural configurations and positional relationships of the first face 432, the second face 434, the conduits 436 and the openings 438 of the first structure 422 about the reference plane 482.

The first structure 422 is spatially displaced from the second structure 422*a* to form a gap 484 therebetween. A mounting structure 486 couples the first structure 422 to the second structure 422*a* with the first face 432 of the first structure 422 opposing the first face 432*a* of the second structure 422*a*.

Similarly as described above, the fluid discharge apparatus 420 is used in conjunction with one of a singulation system and a dicing system. In an exemplary embodiment, a saw jig with a rubber pad support (both not shown) is used for supporting a work-piece 460. The work-piece 460 is one of a semiconductor package and a semiconductor substrate. For example, the work-piece 460 consists of quad-flat no-lead (QFN) packages. Vacuum generated through vacuum holes formed in the rubber pad secures the work-piece 460 to the saw jig both during and after sawing of the work-piece 460.

A conventional saw is used for sawing the work-piece 460. The saw has a cutting blade 450 that is substantially planar, disc-shaped and has a periphery 452. The saw is coupled to a spindle (not shown), which transmits rotational displacement thereto. During a sawing process, the cutting blade 450 rotates at a substantially high rotational speed.

The work-piece 460 has a surface 464 and a cut path along which the cutting blade 450 traverses and interacts with the work-piece 460 at a cutting area 458 for sawing thereof. The cutting blade 450 rotates about an axis that is substantially parallel to the surface 464 of the work-piece 460.

In one instance of the embodiment, the fluid discharge apparatus 420 can be fabricated by machining. For example, the first structure 422 can be fabricated on a milling machine by a combination of cutters to enable high dimensional control of the shape, size and position of the conduits 436, 436*a* and the openings 438, 438*a* in the first structure 422 and the second structure 422*a*. This substantially ensures high manufacturing repeatability of dimensions and relative positions of elements of the fluid discharge apparatus 420, for example, the ducts 428, 428*a*, the openings 438, 438*a* and the conduits 436, 436*a*. The fluid discharge apparatus 420 is made from aluminum. Alternatively, other types of material are useable in fabricating the fluid discharge apparatus 420 from. Alternatively, the fluid discharge apparatus 420 can be fabricated by one of casting and plastic molding.

When the fluid discharge apparatus 420 is used with the saw jig and the saw for singulating the work-piece 460, the cutting blade 450 is received through the gap 484 and positioned in coincidence with the reference plane 482. The fluid discharge apparatus 420 is disposed with the second faces 434, 434*a* of the first and second structures 422, 422*a* facing the work-piece 460 during cutting thereof by the cutting blade 450.

During cutting of the work-piece 460 by the cutting blade 450, heat is generated at the cutting area 458 and on the cutting blade 450. Ineffective cooling of the cutting area 458 results in many undesirable problems including a low quality of cut. Additionally, ineffective cooling of the cutting area 458 limits cutting speed of the saw. This consequently translates into lower production yield.

The substantially planar first faces 432, 432*a* and second faces 434, 434*a* enable the conduits 436, 436*a* of the fluid discharge apparatus 420 to be disposed substantially close to the cutting blade 450 and the surface 464 of the work-piece 460. This enables one or more of the openings 438, 438*a* on the first faces 432, 432*a* to be positioned for directing the fluid streams 447, 447*a* substantially towards the cutting area 458. The cutting area 458 defines an area whereat the cutting blade 450 and the work-piece 460 interact. The cutting area 458 comprises one or more of a portion of the cutting blade 450 and a portion of the work-piece 460. Additionally, as the conduits 436, 436*a* are fabricated by machining, the openings 438, 438*a* can be positioned in a curve along the first faces 432, 432*a* to conform to the curvature of the periphery 452 of the cutting blade 450. For example, the openings 436 are formed along on the first face 432 of the first structure 422 along a curve. This enables the fluid streams 447 to also be substantially delivered to the periphery 452 of the cutting blade 450 whereat heat is concentrated.

The openings 438, 438*a* of both the first and second structures 422, 422*a* are pre-aligned during fabrication of the fluid discharge apparatus 420 for substantially coinciding the longitudinal axis of each of the conduits 436 of the first structure 422 with a corresponding one of the openings 438*a* of the second structure 422*a*. Alternatively, the openings 436 of the first structure 422 are aligned with the conduits 436 thereof having an orientation and position that is symmetrical with the orientation and position of the conduits 436*a* of the second structure 422*a* about the reference plane 482. This substantially ensures that surface portions on one side of the cutting blade 450 whereat fluid steams 447 from the first structure 422 are directed, positionally aligns with surface portions on the other side of the cutting blade 450 whereat fluid steams 447*a* from the second structure 422*a* are directed to thereby align and balance the forces created by the fluid streams 447, 447*a* on both sides of the cutting blade 450.

Deflection of the cutting blade 450 occurs when forces from the water streams 447, 447*a* are not balanced. When the cutting blade 450 is being rotated at a high speed, deflection thereof results in vibrations created by imbalance of forces created by the water streams 447, 447*a* on the cutting blade 450, translates into low quality cuts of the work-piece 460.

As described above, the fluid discharge apparatus 420 can be fabricated by machining of a single block of metal, for example, by milling operations on a block of aluminum. However, alternatively, the first structure 422, second structure 422*a* and the mounting structure 486 are fabricated as separate components to be subsequently assembled.

While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

What is claimed is:

1. A fluid discharge apparatus comprising:

a first structure defining a first duct therein, the first structure further defining a first set of conduits, the first set of conduits extends from the first duct and terminates at a first set of openings, wherein each of the first set of conduits provides an adjustable focus beam of discharge; and a second structure defining a second duct therein, the second structure further defining a second set of conduits, the second set of conduits extends from the second duct and terminates at a second set of openings, wherein each of the second set of conduits provides an adjustable focus beam of discharge, each of the first set of conduits and the second set of conduits being shaped and dimensioned for generating a nozzle-type flow therethrough, the first structure being spatially displaced from the second structure for receiving a cutting blade therebetween, the cutting blade for cutting a work-piece, wherein the first duct is for receiving fluid thereinto and for directing the fluid to the first set of conduits for discharge through the first set of openings and the second duct is for receiving fluid thereinto and for directing the fluid to the second set of conduits for discharge through the second set of openings, the fluid is directed by the first set of conduits and the second set of conduits towards at least one of a portion of the work-piece and two directly outwardly opposing surface portions of the cutting blade, wherein direction of discharge of the fluid from the first set of conduits and second set of conduits is determined by position and orientation of each of the first set of conduits and the second set of conduits, the position and orientation of the first set of conduits with reference to the position and orientation of the second set of conduits is determined during forming of the first set of conduits and the second set of conduits in the first structure and the second structure.

2. The apparatus as in claim 1, further comprising:

a first face extending along a portion of the first structure with the first opening being formed thereon; and a second face extending along a portion of the second structure with the second opening being formed thereon, each of the first face and the second face being substantially planar, wherein the first structure and the second structure are inter-disposed with the first face opposing the second face.

3. The apparatus as in claim 2, each of the first structure and the second structure comprising:

a first longitudinal portion and a second longitudinal portion being inter-configured to substantially form an L-shape, the duct extending from the first longitudinal portion to the second longitudinal portion and terminating at an inlet formed in the second longitudinal portion, wherein the first face extends along the first longitudinal portion and is substantially parallel to the length of the second longitudinal portion.

4. The apparatus as in claim 1, the longitudinal axes of the first set of conduits being substantially coincident with the longitudinal axes of the second set of conduits.

5. The apparatus as in claim 1, each of the first structure and the second structure being rectilinearly shaped.

6. The apparatus as in claim 1, at least one of the first set of conduits and the second set of conduits having one of a substantially uniform length transverse cross-sectional shape and a varying length transverse cross-sectional shape.

7. The apparatus as in claim 1, wherein the first set of openings comprise one of a circular shape and a non-circular geometrical shape.

8. The apparatus as in claim 1, wherein the cutting blade is for cutting a semiconductor substrate.

9. The apparatus as in claim 1, the fluid being at least one of a liquid, a gas and deionised (DI) water.

10. The apparatus as in claim 1, the cutting blade being coupled to a spindle and the spindle for imparting rotational displacement to the cutting blade.

11. The apparatus as in claim 1, the cutting blade being substantially planar, disc-shaped and having a periphery.

12. A fluid discharge method for aligning directions of discharge of fluid streams onto a cutting area, the method comprising:

providing a first structure defining a first duct therein, the first structure further defining a first set of conduits, the first set of conduits extends from the first duct and terminates at a first set of openings, wherein each of the first set of conduits provides an adjustable focus beam of discharge;

providing a second structure defining a second duct therein, the second structure further defining a second set of conduits, the second set of conduits extends from the second duct and terminates at a second set of openings, wherein each of the second set of conduits provides an adjustable focus beam of discharge, each of the first set of conduits and the second set of conduits being shaped and dimensioned for generating a nozzle-type flow therethrough, the first structure being spatially displaced from the second structure, the first duct is for receiving fluid thereinto and for directing the fluid to the first set of conduits for discharge through the first set of openings as a first fluid stream and the second duct is for receiving fluid thereinto and for directing the fluid to the second set of conduits for discharge through the second set of openings as a second fluid stream;

disposing a cutting blade between the first structure and the second structure, the cutting blade for cutting a work-piece; and directing and thereby aligning direction of the first fluid stream with the direction of the second fluid stream discharged onto a cutting area, the cutting area being at least one of a portion of the work-piece and two directly outwardly opposing surface portions of the cutting blade, direction of discharge of the first and second fluid streams being determined by position and orientation of each of the first set of conduits and the second set of conduits, the position and orientation of the first set of conduits with reference to the position and orientation of the second set of conduits being determined during forming of the first set of conduits and the second set of conduits.

13. The method as in claim 12, further comprising:

providing a first face extending along a portion of the first structure with the first opening being formed thereon; and providing a second face extending along a portion of the second structure with the second opening being formed thereon, each of the first face and the second face being substantially planar, wherein the first structure and the second structure are inter-disposed with the first face opposing the second face.

14. The method as in claim 13, each of the first structure and the second structure comprising:

a first longitudinal portion and a second longitudinal portion being inter-configured to substantially form an L-shape, the duct extending from the first longitudinal portion to the second longitudinal portion and terminating at an inlet formed in the second longitudinal portion, wherein the first face extends along the first longitudinal portion and is substantially parallel to the length of the second longitudinal portion.

15. The method as in claim 12, the longitudinal axes of the first set of conduits being substantially coincident with the longitudinal axes of the second set of conduits.

16. The method as in claim 12, each of the first structure and the second structure being rectilinearly shaped.

17. The method as in claim 12, at least one of the first set of conduits and the second set of conduits having one of a substantially uniform length transverse cross-sectional shape and a varying length transverse cross-sectional shape.

18. The method as in claim 12, wherein the first set of openings comprise one of a circular shape and a non-circular geometrical shape.

19. The method as in claim 12, the work-piece being a semiconductor substrate.

20. The method as in claim 12, the fluid being at least one of a liquid, a gas and deionised (DI) water.

21. The method as in claim 12, wherein the first structure and the second structure each defines at least one supplemental duct therein.

22. The method as in claim 21, wherein the first structure and the second structure each is configured to mix material flowing through each duct therein prior to discharge.

23. A fluid discharge apparatus forming method comprising:

forming a first structure defining a first duct therein;

forming a second structure defining a second duct therein, the first structure being spatially displaced from the second structure;

forming a first set of conduits in the first structure, the first set of conduits extending from the first duct and terminating at a first set of openings, wherein each of the first set of conduits provides an adjustable focus beam of discharge; and forming a second set of conduits in the second structure, the second set of conduits extending from the second duct and terminating at a second set of openings, wherein each of the second set of conduits provides an adjustable focus beam of discharge, each of the first structure and the second structure being inter-disposed in a pre-determined configuration one of prior to and during forming of the first set of conduits and the second set of conduits, each of the first set of conduits and the second set of conduits being shaped and dimensioned for generating a nozzle-type flow therethrough, the first duct is for receiving fluid thereinto and for directing the fluid to the first set of conduits for discharge through the first set of openings and the second duct is for receiving fluid thereinto and for directing the fluid to the second set of conduits for discharge through the second set of openings, wherein a cutting blade for cutting a work-piece is disposable between the first structure and the second structure, the fluid discharged by the first set of conduits and the second set of conduits is directed towards at least one of a portion of the work-piece and two directly outwardly opposing surface portions of the cutting blade, direction of discharge of the fluid from the first set of conduits and second set of conduits is determined by position and orientation of each of the first set of conduits and the second set of conduits, the position and orientation of the first set of conduits with reference to the position and orientation of the second set of conduits is determined during forming of the first set of conduits and the second set of conduits.

24. The method as in claim 23, further comprising:

forming a first face along a portion of the first structure with the first opening being formed thereon; and forming a second face extending along a portion of the second structure with the second opening being formed thereon, each of the first face and the second face being substantially planar, wherein the first structure and the second structure are inter-disposed with the first face opposing the second face.

25. The method as in claim 24, each of the first structure and the second structure comprising:

a first longitudinal portion and a second longitudinal portion being inter-configured to substantially form an L-shape, the duct extending from the first longitudinal portion to the second longitudinal portion and terminating at an inlet formed in the second longitudinal portion, wherein the first face extends along the first longitudinal portion and is substantially parallel to the length of the second longitudinal portion.

26. The method as in claim 23, the longitudinal axes of the first set of conduits being substantially coincident with the longitudinal axes of the second set of conduits.

27. The method as in claim 23, each of the first structure and the second structure being rectilinearly shaped.

28. The method as in claim 23, at least one of the first set of conduits and the second set of conduits having one of a substantially uniform length transverse cross-sectional shape and a varying length transverse cross-sectional shape.

29. The method as in claim 23, wherein the first set of openings comprise one of a circular shape and a non-circular geometrical shape.

30. The method as in claim 23, wherein the cutting blade is for cutting a semiconductor substrate.

31. The method as in claim 23, the fluid being at least one of a liquid, a gas and deionised (DI) water.

32. The method as in claim 23, the cutting blade being coupled to a spindle and the spindle for imparting rotational displacement to the cutting blade.

33. The method as in claim 23, the cutting blade being substantially planar, disc-shaped and having a periphery.

34. A fluid discharge apparatus comprising:

a structure defining a duct and a plurality of conduits therein, wherein the plurality of conduits extends from the duct and terminates at least one opening formed in the structure, wherein the plurality of conduits provides an adjustable focus beam of discharge, at least one of the plurality of conduits being shaped and dimensioned for generating a nozzle-type flow therethrough, the structure is disposable adjacent at least one of a work-piece and a cutting blade for cutting the work-piece, wherein the duct is for receiving fluid thereinto and for directing the fluid to the plurality of conduits for discharge through the at least one opening of at least one of the plurality of conduits, the fluid is directed by the plurality of conduits towards at least one of a portion of the work-piece and a directly outwardly opposing surface portions of the cutting blade, wherein direction of discharge of the fluid from the plurality of conduits is determined by position and orientation of each of the plurality of conduits, and the position and orientation of each of the plurality of conduits is determined prior to forming each of the plurality of conduits in the structure.

35. The apparatus as in claim 34, further comprising:

a first face extending along a portion of the structure with the first opening being formed thereon, the opening of at least one of the plurality of conduits being formed on the first face.

36. The apparatus as in claim 34, the structure being rectilinearly shaped.

37. The apparatus as in claim 34, the structure comprising:

a first longitudinal portion and a second longitudinal portion being inter-configured to substantially form an L-shape, the duct extending from the first longitudinal portion to the second longitudinal portion and terminating at an inlet formed in the second longitudinal portion, wherein the first face extends along the first longitudinal portion and is substantially parallel to the length of the second longitudinal portion.

38. The apparatus as in claim 34, at least one of the plurality of conduits having one of a substantially uniform length transverse cross-sectional shape and a varying length transverse cross-sectional shape.

39. The apparatus as in claim 34, the at least one opening of at least one of the plurality of conduits having one of a circular shape and a non-circular geometrical shape.

40. The apparatus as in claim 34, wherein the cutting blade is for cutting a semiconductor substrate.

41. The apparatus as in claim 34, the fluid being at least one of a liquid, a gas and deionised (DI) water.

42. The apparatus as in claim 34, the cutting blade being coupled to a spindle and the spindle for imparting rotational displacement to the cutting blade.

43. The apparatus as in claim 34, the cutting blade being substantially planar, disc-shaped and having a periphery.

44. A fluid discharge apparatus comprising:

a first structure defining a first duct therein, the first structure further defining a first set of conduits, the first set of conduits extends from the first duct and terminates at a first set of openings, wherein each of the first set of conduits provides an adjustable focus beam of discharge;

a second structure defining a second duct therein, the second structure further defining a second set of conduits, the second set of conduits extends from the second duct and terminates at a second set of openings, wherein each of the second set of conduits provides an adjustable focus beam of discharge; and a third structure defining a third duct therein, the third structure further defining a third conduit, the third conduit extends from the third duct and terminates at a third opening, wherein the third conduit provides an adjustable focus beam of discharge, each of the first set of conduits, the second set of conduits and the third conduit being shaped and dimensioned for generating a nozzle-type flow therethrough, the first structure being spatially displaced from the second structure for receiving a cutting blade therebetween, the cutting blade for cutting a work-piece, wherein the first duct is for receiving fluid thereinto and for directing the fluid to the first set of conduits for discharge through the first set of openings, the second duct is for receiving fluid thereinto and for directing the fluid to the second set of conduits for discharge through the second set of openings and the third duct is for receiving fluid thereinto and for directing the fluid to the third conduit for discharge through the third opening, the fluid is directed by the first set of conduits and the second set of conduits towards at least one of a portion of the work-piece and two directly outwardly opposing surface portions of the cutting blade, the fluid is further directed by the third conduit towards at least one of a portion of the work-piece and two directly towards portions of the cutting blade, wherein direction of discharge of the fluid from the first set of conduits, the second set of conduits and the third conduit is determined by position and orientation of each of the first set of conduits, the second set of conduits and the third conduit, the position and orientation of the first set of conduits with reference to the position and orientation of the second set of conduits and the third conduit is determined during forming of the first set of conduits, the second set of conduits and the third conduit in the first structure, the second structure and the third structure.

45. The apparatus as in claim 44, further comprising:

a first section extending along a portion of the first structure with the first set of openings being formed thereon;

a second section extending along a portion of the second structure with the second set of openings being formed thereon; and a third section of the third structure with the third opening being formed thereon, each of the first section, the second section and the third section being substantially cylindrical, wherein the first structure and the second structure are inter-disposed with the first set of openings opposing the second set of openings and the third structure is disposed with the third opening towards the cutting blade.

46. The apparatus as in claim 45, each of the first structure and the second structure comprising:

a first longitudinal portion and a second longitudinal portion being inter-configured to substantially form an L-shape, the first longitudinal portion and the second longitudinal portion being joined with a rounded portion, the duct extending from the first longitudinal portion to the second longitudinal portion and terminating at an inlet formed in the second longitudinal portion, wherein the first section extends along the first longitudinal portion and is substantially perpendicular to the length of the second longitudinal portion.

47. The apparatus as in claim 45, the third structure comprising:

a first longitudinal portion and a second longitudinal portion being configured to substantially form an L-shape, the first longitudinal portion and the second longitudinal portion being joined with a rounded portion, the duct extending from the first longitudinal portion to the second longitudinal portion and terminating at a second inlet formed in the second longitudinal portion, wherein the third section extends along the first longitudinal portion and is substantially perpendicular to the length of the second longitudinal portion.

48. The apparatus as in claim 44, the longitudinal axes of the first set of conduits being substantially coincident with the longitudinal axes of the second set of conduits, the longitudinal axis of the third conduit being substantially perpendicular with the longitudinal axes of the first set of conduits and the second set of conduits.

49. The apparatus as in claim 44, each of the first structure, the second structure and the third structure being cylindrically shaped.

50. The apparatus as in claim 44, at least one of the first set of conduits, the second set of conduits and the third conduit having one of a substantially uniform length transverse cross-sectional shape and a varying length transverse cross-sectional shape.

51. The apparatus as in claim 44, wherein the first set of openings comprise one of a circular shape and a non-circular geometrical shape.

52. The apparatus as in claim 44, wherein the cutting blade is for cutting a semiconductor substrate.

53. The apparatus as in claim 44, the fluid being at least one of a liquid, a gas and deionised (DI) water.

54. The apparatus as in claim 44, the cutting blade being coupled to a spindle and the spindle for imparting rotational displacement to the cutting blade.

55. The apparatus as in claim 44, the cutting blade being substantially planar, disc-shaped and having a periphery.

56. A fluid discharge method for aligning directions of discharge of fluid streams onto a cutting area, the method comprising:

providing a first structure defining a first duct therein, the first structure further defining a first set of conduits, the first set of conduits extends from the first duct and terminates at a first set of openings, wherein each of the first set of conduits provides an adjustable focus beam of discharge;

providing a second structure defining a second duct therein, the second structure further defining a second set of conduits, the second set of conduits extends from the second duct and terminates at a second set of openings, wherein each of the second set of conduits provides an adjustable focus beam of discharge;

providing a third structure defining a third duct therein, the third structure further defining a third conduit, the third conduit extends from the third duct and terminates at a third opening, wherein the third conduit provides an adjustable focus beam of discharge, each of the first set of conduits, the second set of conduits and the third conduit being shaped and dimensioned for generating a nozzle-type flow therethrough, the first structure being spatially displaced from the second structure, the first duct is for receiving fluid thereinto and for directing the fluid to the first set of conduits for discharge through the first set of openings as a first fluid stream, the second duct is for receiving fluid thereinto and for directing the fluid to the second set of conduits for discharge through the second set of openings as a second fluid stream and the third duct is for receiving fluid thereinto and for directing the fluid to the third conduit for discharge through the third opening as a third fluid stream;

disposing a cutting blade between the first structure and the second structure, the cutting blade for cutting a work-piece; and directing and thereby aligning direction of the first fluid stream with the direction of the second fluid stream discharged onto the cutting area, the cutting area being at least one of a portion of the work-piece and two directly outwardly opposing surface portions of the cutting blade, directing and thereby aligning direction of the third fluid stream with the cutting area, direction of discharge of the first, second and third fluid streams being determined by position and orientation of each of the first set of conduits, the second set of conduits and the third conduit, the position and orientation of the first set of conduits with reference to the position and orientation of the second set of conduits being determined during forming of the first set of conduits and the second set of conduits.

57. The method as in claim 56, further comprising:

providing a first section extending along a portion of the first structure with the first set of openings being formed thereon;

providing a second section extending along a portion of the second structure with the second set of openings being formed thereon; and providing a third section of the third structure with the third opening being formed thereon, each of the first section, the second section and the third section being substantially cylindrical, wherein the first structure and the second structure are inter-disposed with the first set of openings opposing the second set of openings and the third structure is disposed with the third opening towards the cutting blade.

58. The method as in claim 57, each of the first structure and the second structure comprising:

a first longitudinal portion and a second longitudinal portion being inter-configured to substantially form an L-shape, the first longitudinal portion and the second longitudinal portion being joined with a rounded portion, the duct extending from the first longitudinal portion to the second longitudinal portion and terminating at an inlet formed in the second longitudinal portion, wherein the first section extends along the first longitudinal portion and is substantially perpendicular to the length of the second longitudinal portion.

59. The method as in claim 57, the third structure comprising:

a first longitudinal portion and a second longitudinal portion being configured to substantially form an L-shape, the first longitudinal portion and the second longitudinal portion being joined with a rounded portion, the duct extending from the first longitudinal portion to the second longitudinal portion and terminating at a second inlet formed in the second longitudinal portion, wherein the third section extends along the first longitudinal portion and is substantially perpendicular to the length of the second longitudinal portion.

60. The method as in claim 56, the longitudinal axes of the first set of conduits being substantially coincident with the longitudinal axes of the second set of conduits, the longitudinal axis of the third conduit being substantially perpendicular with the longitudinal axes of the first set of conduits and the second set of conduits.

61. The method as in claim 56, each of the first structure, the second structure and the third structure being cylindrically shaped.

62. The method as in claim 56, at least one of the first set of conduits, the second set of conduits and the third conduit having one of a substantially uniform length transverse cross-sectional shape and a varying length transverse cross-sectional shape.

63. The method as in claim 56, wherein the first set of openings comprise one of a circular shape and a non-circular geometrical shape.

64. The method as in claim 56, wherein the cutting blade is for cutting a semiconductor substrate.

65. The method as in claim 56, the fluid being at least one of a liquid, a gas and deionised (DI) water.

66. The method as in claim 56, the cutting blade being coupled to a spindle and the spindle for imparting rotational displacement to the cutting blade.

67. The method as in claim 56, the cutting blade being substantially planar, disc-shaped and having a periphery.

68. A fluid discharge apparatus forming method comprising:

forming a first structure defining a first duct therein;

forming a second structure defining a second duct therein, the first structure being spatially displaced from the second structure;

forming a third structure defining a third duct therein, the third structure being spatially displaced from the first and second structure;

forming a first set of conduits in the first structure, the first set of conduits extending from the first duct and terminating at a first set of openings, wherein each of the first set of conduits provides an adjustable focus beam of discharge;

forming a second set of conduits in the second structure, the second set of conduits extending from the second duct and terminating at a second set of openings, wherein each of the second set of conduits provides an adjustable focus beam of discharge; and forming a third conduit in the third structure, the third conduit extending from the third duct and terminating at a third opening, wherein the third conduit provides an adjustable focus beam of discharge, each of the first structure, the second structure and the third structure being inter-disposed in a pre-determined configuration one of prior to and during forming of the first set of conduits, the second set of conduits and the third conduit, each of the first set of conduits, the second set of conduits and the third conduit being shaped and dimensioned for generating a nozzle-type flow therethrough, the first duct is for receiving fluid thereinto and for directing the fluid to the first set of conduits for discharge through the first set of openings, the second duct is for receiving fluid thereinto and for directing the fluid to the second set of conduits for discharge through the second set of openings and the third duct is for receiving fluid thereinto and for directing the fluid to the third conduit for discharge through the third opening, wherein a cutting blade for cutting a work-piece is disposable between the first structure, the second structure and the third structure, the fluid discharged by the first set of conduits and the second set of conduits is directed towards at least one of a portion of the work-piece and two directly outwardly opposing surface portions of the cutting blade, the fluid discharged by the third conduit is directed towards at least one of a portion of the work-piece and two directly towards portions of the cutting blade, direction of discharge of the fluid from the first set of conduits, second set of conduits and third conduit is determined by position and orientation of each of the first set of conduits, the second set of conduits and the third conduit, the position and orientation of the first set of conduits with reference to the position and orientation of the second set of conduits is determined during forming of the first set of conduits and the second set of conduits.

69. The method as in claim 68, further comprising:

forming a first section extending along a portion of the first structure with the first set of openings being formed thereon;

forming a second section extending along a portion of the second structure with the second set of openings being formed thereon; and forming a third section of the third structure with the third opening being formed thereon, each of the first section, the second section and the third section being substantially cylindrical, wherein the first structure and the second structure are inter-disposed with the first set of openings opposing the second set of openings and the third structure is disposed with the third opening towards the cutting blade.

70. The method as in claim 69, each of the first structure and the second structure comprising:

a first longitudinal portion and a second longitudinal portion being inter-configured to substantially form an L-shape, the first longitudinal portion and the second longitudinal portion being joined with a rounded portion, the duct extending from the first longitudinal portion to the second longitudinal portion and terminating at an inlet formed in the second longitudinal portion, wherein the first section extends along the first longitudinal portion and is substantially perpendicular to the length of the second longitudinal portion.

71. The method as in claim 69, the third structure comprising:

a first longitudinal portion and a second longitudinal portion being configured to substantially form an L-shape, the first longitudinal portion and the second longitudinal portion being joined with a rounded portion, the duct extending from the first longitudinal portion to the second longitudinal portion and terminating at a second inlet formed in the second longitudinal portion, wherein the third section extends along the first longitudinal portion and is substantially perpendicular to the length of the second longitudinal portion.

72. The method as in claim 68, the longitudinal axes of the first set of conduits being substantially coincident with the longitudinal axes of the second set of conduits, the longitudinal axis of the third conduit being substantially perpendicular with the longitudinal axes of the first set of conduits and the second set of conduits.

73. The method as in claim 68, each of the first structure, the second structure and the third structure being cylindrically shaped.

74. The method as in claim 68, at least one of the first set of conduits, the second set of conduits and the third conduit having one of a substantially uniform length transverse cross-sectional shape and a varying length transverse cross-sectional shape.

75. The method as in claim 68, wherein the first set of openings comprise one of a circular shape and a non-circular geometrical shape.

76. The method as in claim 68, wherein the cutting blade is for cutting a semiconductor substrate.

77. The method as in claim 68, the fluid being at least one of a liquid, a gas and deionised (DI) water.

78. The method as in claim 68, the cutting blade being coupled to a spindle and the spindle for imparting rotational displacement to the cutting blade.

79. The method as in claim 68, the cutting blade being substantially planar, disc-shaped and having a periphery.

80. A fluid discharge apparatus comprising:

a first structure defining a first duct therein, the first structure further defining a first set of conduits, the first set of conduits extends from the first duct and terminates at a first set of openings, wherein each of the first set of conduits provides a column beam of discharge; and a second structure defining a second duct therein, the second structure further defining a second set of conduits, the second set of conduits extends from the second duct and terminates at a second set of openings, wherein each of the second set of conduits provides a column beam of discharge, each of the first set of conduits and the second set of conduits being shaped and dimensioned for generating a nozzle-type flow therethrough, the first structure being spatially displaced from the second structure for receiving a cutting blade therebetween, the cutting blade for cutting a work-piece, wherein the first duct is for receiving fluid thereinto and for directing the fluid to the first set of conduits for discharge through the first set of openings and the second duct is for receiving fluid thereinto and for directing the fluid to the second set of conduits for discharge through the second set of openings, the fluid is directed by the first set of conduits and the second set of conduits towards at least one of a portion of the work-piece and two directly outwardly opposing surface portions of the cutting blade, wherein direction of discharge of the fluid from the first set of conduits and second set of conduits is determined by position and orientation of each of the first set of conduits and the second set of conduits, the position and orientation of the first set of conduits with reference to the position and orientation of the second set of conduits is determined during forming of the first set of conduits and the second set of conduits in the first structure and the second structure.

* * * * *